US007932881B2

(12) United States Patent
Kageyama et al.

(10) Patent No.: US 7,932,881 B2
(45) Date of Patent: Apr. 26, 2011

(54) IMAGE DISPLAY DEVICE AND DRIVER CIRCUIT THEREFOR

(75) Inventors: Hiroshi Kageyama, Hachioji (JP); Hajime Akimoto, Kokubunji (JP)

(73) Assignee: Hitacji Displays, Ltd., Chiba (JP)

( * ) Notice: Subject to any disclaimer, the term of this patent is extended or adjusted under 35 U.S.C. 154(b) by 767 days.

(21) Appl. No.: 11/544,735

(22) Filed: Oct. 10, 2006

(65) Prior Publication Data

US 2007/0091034 A1 Apr. 26, 2007

(30) Foreign Application Priority Data

Oct. 12, 2005 (JP) ..... 2005-297643

(51) Int. Cl.
*G09G 3/30* (2006.01)

(52) U.S. Cl. ..... 345/78; 345/76

(58) Field of Classification Search ..... 345/73–84, 345/204–215; 315/169.1–169.4; 313/463
See application file for complete search history.

(56) References Cited

U.S. PATENT DOCUMENTS

| | | | | |
|---|---|---|---|---|
| 2,527,026 | A * | 10/1950 | Mucher | 338/57 |
| 4,398,207 | A * | 8/1983 | Hoff et al. | 257/379 |
| 4,446,436 | A * | 5/1984 | Ireland | 327/107 |
| 5,180,987 | A * | 1/1993 | Wendt | 327/105 |
| 6,876,345 | B2 * | 4/2005 | Akimoto et al. | 345/76 |
| 2005/0057581 | A1 * | 3/2005 | Horiuchi et al. | 345/690 |
| 2006/0197462 | A1 * | 9/2006 | Uchiyama et al. | 315/169.3 |

FOREIGN PATENT DOCUMENTS

| | | |
|---|---|---|
| AL | 2004-510208 | 4/2004 |
| JP | 2003-5709 | 1/2003 |
| JP | 2003-122301 | 4/2003 |
| WO | WO 02/27700 | 4/2002 |

* cited by examiner

*Primary Examiner* — Alexander Eisen
*Assistant Examiner* — Patrick Marinelli
(74) *Attorney, Agent, or Firm* — Miles & Stockbridge P.C.

(57) ABSTRACT

A waveform generator can be constructed at a small area size using thin-film transistors and generates multiple triangular-wave voltage waveforms different from one another in phase, and an image display device that applies the waveform generator.

A waveform generator that uses loop-form resistive wiring is provided on a substrate. The waveform generator supplies a triangular-wave voltage waveform or stepped voltage waveform of a voltage signal occurring in the loop-form resistive wiring to pixel circuits. The loop-form resistive wiring has multiple voltage supply switches that supply at least two kinds of voltages.

8 Claims, 20 Drawing Sheets

PRIOR ART
FIG.17A
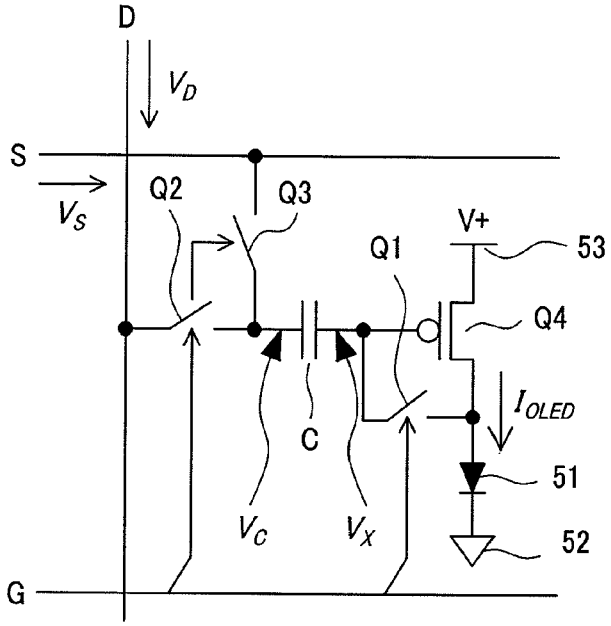
PRIOR ART
FIG.17B
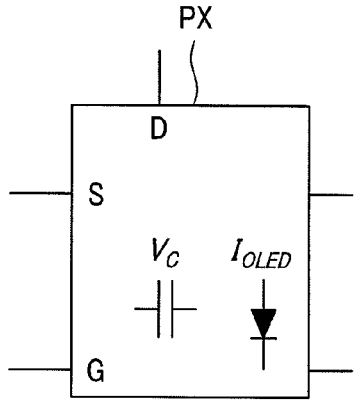
FIG.18
PRIOR ART
| G | Q1 | Q2 | Q3 |
|---|---|---|---|
| H | ON | ON | OFF |
| L | OFF | OFF | ON |

IMAGE DISPLAY DEVICE AND DRIVER CIRCUIT THEREFOR

CLAIM OF PRIORITY

The present application claims priority from Japanese application JP 2005-297643 filed on Oct. 12, 2005, the content of which is hereby incorporated by reference into this application.

BACKGROUND OF THE INVENTION

The present invention relates to image display devices and to driver circuits therefor. More particularly, the invention relates to an active-matrix type of display device with built-in pixel circuits, the display device further having a driver circuit on a substrate and reducing an area of a non-display region, and to the driver circuit.

Electroluminescent (EL) displays that use EL elements are reported as the image display devices that use light-emitting elements to form pixels. Active-matrix types of EL displays further contain pixel circuits, each of which includes wiring routed in matrix form to transmit signals and electric currents and employs, in addition to EL elements, thin-film transistors (TFTs) that are active elements, to form pixels.

Pixel circuits control the light-emitting luminance of EL elements by controlling electric currents which the pixel circuits are to supply to the EL elements. A method of controlling currents by using pixel circuits is reported in Japanese Patent Laid-Open No. 2003-122301 (refer to Patent Document 1). Also, organic EL diodes are known as EL elements whose light-emitting luminance changes in proportion to the amount of current.

The circuit composition of a conventional pixel circuit PX which uses an EL element is shown in FIG. 17A. A pixel circuit PX equivalent to that of FIG. 17A is shown in simplified form in FIG. 17B. These pixel circuits PX include a data line D for transmitting an image signal voltage $V_D$, a gate line G for transmitting a scanning pulse, a triangular-wave signal line S for transmitting a triangular-wave voltage waveform $V_s$, TFTs_Q1 to Q3 each functioning as a switch, a p-channel TFT_Q4 for controlling a current, and a capacitor C. Although an EL element 51 and a grounding electrode 52 are also shown in FIGS. 17A and 17B, these two elements are, as a matter of fact, created in overlapped form by vapor-depositing a light-emitting organic film and common electrode not shown. A current $I_{OLED}$ that flows into the EL element is supplied from a power supply line 53, then passed through the TFT_Q4 and the EL element 51, and flows into the grounding electrode 52. The light-emitting intensity of the EL element 51 is proportionate to a time-varying integral quantity of current $I_{OLED}$ flowing during a vertical scanning period.

The relationship between the logical state of the gate line G and the ON/OFF operation of the TFTs_Q1 to Q3 is shown in FIG. 18. When the gate line G is at a high (H) level, the TFTs_Q1 and Q2 are active (ON) and the TFT_Q3 is inactive (OFF). Under this state, the pixel circuit PX reads the image signal voltage $V_D$ of the data line D into the capacitor. When the gate line G is at a low (L) level, the TFTs_Q1 and Q2 are OFF and the TFT_Q3 is ON. Under this state, the pixel circuit 13 compares the triangular-wave voltage waveform $V_S$ and the voltage which the pixel circuit has read into the capacitor, and depending on the relationship in magnitude between both voltages, controls whether the current $I_{OLED}$ is to be conducted (supplied).

The principles of operation of the pixel circuit PX when it controls the brightness of the EL element 51 by using the image signal voltage $V_D$ are described hereunder.

FIG. 19 shows examples of operation waveforms of each section in the pixel circuit PX of FIG. 17A. A pulse is supplied to the gate line G with each arrival of the vertical scanning period $T_V$. When the pulse is input to the gate line G (i.e., when G takes level H), the voltage $V_D$ of the data line D is read into the capacitor C. A voltage $V_C$ of a node located to the left of the capacitor C takes the same value as that of the then voltage $V_D$ of the data line D. At the same time, when Q1 turns ON, a voltage $V_X$ developed at the right side of the capacitor C becomes a voltage $V_{RES}$ used as a threshold of a criterion for the TFT_Q4 to judge whether it is to conduct the current $I_{OLED}$. When a pulse is not input to the gate line G (i.e., when G takes level L), the voltage waveform $V_S$ of the triangular-wave signal line S is applied to the capacitor C and the voltage $V_C$ of the node located to the left of the capacitor C takes the same waveform as the triangular-wave voltage waveform $V_S$. When the triangular-wave voltage is high in comparison with the voltage $V_D$ of the data line D at level H of the gate line G, the TFT_Q4 is in an OFF state and the current $I_{OLED}$ is not flowing. Conversely, when the triangular-wave voltage is low in comparison with the voltage $V_D$ of the data line D at level H of the gate line G, the TFT_Q4 is in an ON state and the current $I_{OLED}$ is flowing.

An example in FIG. 19 shows a relatively low voltage $V_{DL}$ as the image signal voltage $V_D$ of the data line at time "t1". The voltage $V_{DL}$ is read into the capacitor C in synchronization with the pulse of the gate line G. During a period from time "$t_1$" to time "$t_2$", although the triangular-wave voltage waveform $V_S$ is supplied to the node located to the left of the capacitor, the voltage that the capacitor C holds between electrodes causes the node voltage $V_X$ at the right side of the capacitor to take a waveform obtained by shifting the voltage waveform of the voltage $V_C$ so that a relatively high $V_C$ voltage value is obtained. Accordingly, an integral quantity of current $I_{OLED}$ flowing during the vertical scanning period $T_V$ relatively decreases and the EL element 21 looks relatively dark.

Another example in FIG. 19 shows a relatively high voltage $V_{DH}$ as the image signal voltage $V_D$ of the data line at time "$t_2$". The voltage $V_{DH}$ is read into the capacitor C in synchronization with the pulse of the gate line G. During a period from time "$t_2$" to time "$t_3$", although the triangular-wave voltage waveform $V_S$ is supplied to the node located to the left of the capacitor, the voltage that the capacitor C holds between electrodes causes the node voltage $V_X$ at the right side of the capacitor to take a waveform obtained by shifting the voltage waveform of the voltage $V_C$ so that a relatively low $V_C$ voltage value is obtained. Accordingly, an integral quantity of current $I_{OLED}$ flowing during the vertical scanning period $T_V$ relatively increases and the EL element 21 looks relatively bright. The composition and driving principles of the pixel circuit are described in further detail in Japanese Patent Laid-Open No. 2003-005709 (refer to Patent Document 2).

As described above, an image display device can be created by forming on a substrate a matrix-form array of pixel circuits each capable of controlling the brightness of an EL element by using an image signal voltage $V_D$.

A configuration of a conventional image display device created using pixel circuits PX is shown in FIG. 20. A plurality of pixel circuits PX are arranged in matrix form in an image display region 62 on the surface of a transparent glass substrate 60. Data driver LSI 64, a scanning circuit 65, and signal generators (S_GENE) 66 to 69 are arranged around the display region 62. An output of the scanning circuit 65 is connected to each pixel circuit PX via gate lines G1 to G4, and an output of the data driver LSI 64 is connected to each pixel circuit PX via a data line 75. Outputs of the signal generators 66 to 69 are connected to the respective pixel circuits PX through triangular-wave signal lines S1 to S4. In synchronization with pulses of the gate lines G1 to G4, the signal generators 66 to 69 generate V-shaped triangular-wave voltage waveforms $V_{S1}$, to $V_{S4}$, respectively, that differ from one another in terms of phase.

In FIG. 20, only five pixel circuits PX, one in an X-direction and four in a Y-direction, are shown for a better understanding of description. A general image display device, however, has at least several hundreds of pixel circuits arrayed in both X- and Y-directions. These pixel circuits PX take the circuit composition shown in FIG. 17A. A shift register circuit composed of multiple latches is used as a scanning circuit 65. Although the number of latches in the scanning circuit 65 and the number of signal generators 66 to 69 are both four in FIG. 20, the actual number of these elements is the same as used in the Y-direction of the pixel circuit composition.

FIG. 21 shows the voltage waveforms that data driver LSI 64, scanning circuit 65, and signal waveform generators 66 to 69 generate. The data driver LSI 64 sequentially outputs image signal voltages $V_{D1}$ to $V_{D4}$ to a data line 75, and the scanning circuit 65 outputs a pulse signal Sync to gate lines G1 to G4 in synchronization with the image signal voltages $V_{D1}$ to $V_{D4}$. Since the signal generators (S_GENE) 66 to 69 each supplying a triangular wave synchronously with the pulse signal that the scanning circuit 65 generates are provided, the signal generators 66 to 69 generate triangular-wave voltage waveforms $V_{S1}$ to $V_{S4}$, respectively, that differ from one another in terms of phase. Hence, synchronization between the pulse signal and the triangular-wave voltage waveform can be obtained over an entire vertical scanning period $T_V$ in all pixel circuits PX.

All pixel circuits can operate as shown in FIG. 19. One method of realizing the signal generators 66 to 69 is by using such integrators that are reported per FIGS. 7 and 10 of Japanese Patent Laid-Open No. 2004-510208.

[Patent Document 1]

Japanese Patent Laid-Open No. 2003-122301

[Patent Document 2]

Japanese Patent Laid-Open No. 2003-005709

[Patent Document 3]

Japanese Patent Laid-Open No. 2004-510208

SUMMARY OF THE INVENTION

The signal generators 66 to 69 have been necessary for generating the V-shaped triangular-wave voltage waveforms $V_{S1}$ to $V_{S4}$, respectively, that differ from one another in terms of phase, as shown in FIG. 21. However, it has been difficult to use TFTs to form such integrator as reported per FIG. 10 of Japanese Patent Laid-Open No. 2004-510208. Variations in the electrical characteristics of TFTs, such as threshold voltage Vth and mobility "μ", are extremely significant, compared with those of the LSI manufactured using monocrystal silicon.

Accordingly, if an analog amplifier necessary to compose the integrator is formed of a TFT, the characteristics of the analog amplifier will change very significantly and high-accuracy triangular-wave signal waveform will be difficult to output. In addition, since the process of creating a TFT is generally at least one digit lower than a monocrystal-silicon LSI creating process in processing accuracy, an integrator formed up of TFTs is complex in circuit composition and requires a wide circuit area. Arranging such an integrator for each gate line will increase the circuit area requirement very significantly, augmenting the marginal region (non-display section) of the display screen of the image display device manufactured.

Another usable method of creating the signal generators 66 to 69 is by using LSI formed of monocrystal silicon and mounting the LSI on a glass substrate. In this method, although high-accuracy triangular-wave signal waveforms can be generated, one more LSI chip for generating a triangular-wave signal waveform must be provided in addition to a data driver LSI chip, so the cost of the image display device is increased by the manufacturing and mounting expenses required for the additional LSI chip.

Accordingly, an object of the present invention is to provide: a waveform generator capable of being constructed with a small area, even by use of thin-film transistors, and generating a plurality of triangular-wave signal waveforms different from one another in terms of phase; and an image display device applying the waveform generator.

Typical examples of the aspects of the present invention that are disclosed in this Specification are outlined below.

That is to say, an image display device according to an aspect of the present invention includes on a substrate: a plurality of pixel circuits each including a light-emitting element and a circuit element which conducts quantitative control of an electric current supplied to the light-emitting element, the pixel circuits being arrayed in a matrix form; a scanning circuit that controls operation of the plurality of pixel circuits; a data driver for supplying an image signal voltage to the plurality of pixel circuits; a plurality of gate lines each for transmitting to the plurality of pixel circuits a signal which the scanning circuit generates; a plurality of data lines intersecting with the gate lines, each of the data lines supplying another image signal voltage to the plurality of pixel circuits; and a waveform generator that uses loop-form resistive wiring on the substrate; wherein the waveform generator supplies to each of the pixel circuits a triangular-wave voltage waveform or stepped voltage waveform of a voltage signal occurring in the loop-form resistive wiring.

Another aspect of the present invention is a driver circuit for an image display device with thin-film transistors in pixel circuits, the driver circuit including, on a substrate constituting the image display device: a waveform generator that is formed up of loop-form resistive wiring and a plurality of voltage supply switches for supplying at least two kinds of voltages to the loop-form resistive wiring, each of the voltage supply switches being formed using thin-film transistors; wherein the driver circuit for the image display device outputs to all of the pixel circuits a plurality of triangular-wave voltage waveforms or stepped voltage waveforms different from one another in terms of phase, the triangular-wave voltage waveforms or the stepped voltage waveforms being voltage waveforms of voltage signals occurring in the loop-form resistive wiring of the waveform generator.

Effects of the Invention

According to the present invention, an image display device with a display screen whose marginal region (non-display section) is dimensionally minimized can be provided since the image display device employs a waveform generator of simple circuit composition without an integrator. In addition, since the waveform generator to be mounted in the image display device can be constituted by thin-film transistors, the image display device does not require special LSI and can be created at a lower cost than the image display devices manufactured using the foregoing conventional techniques.

BRIEF DESCRIPTION OF THE DRAWINGS

FIGS. 17A and 17B are diagrams that show circuit composition of a conventional pixel circuit PX which uses an EL element;

FIG. 18 is a diagram that shows the relationship between a logical state of the gate line G shown in FIG. 17, and ON/OFF operation of TFTs;

DETAILED DESCRIPTION OF THE INVENTION

Next, preferred embodiments of the present invention will be described in detail hereunder with reference being made to the accompanying drawings.

First Embodiment

Figure 1:
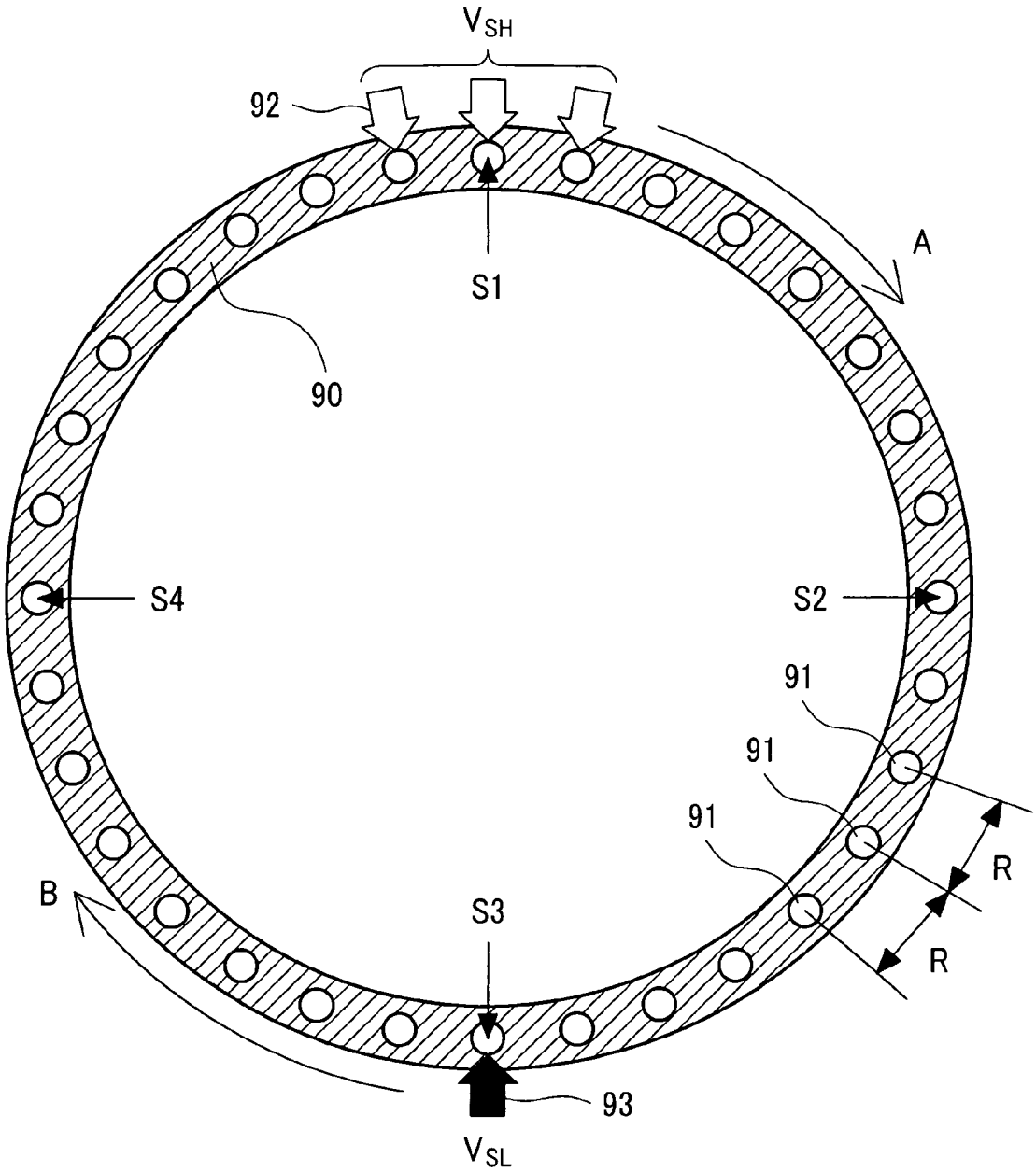
FIG. 1 is a driver circuit diagram showing a first embodiment of an image display device according to the present invention.

FIG. 1 shows a first embodiment of a driver circuit for mounting in an image display device of the present invention. The driver circuit of the present embodiment includes a loop-form resistor 90, a plurality of terminals 91 provided on the loop-form resistor, a voltage supply electrode 92 for supplying a maximum voltage $V_{SH}$ of an output waveform, and a voltage supply electrode 93 for supplying a minimum voltage $V_{SL}$ of an output waveform. The number of terminals 91 provided is equal to that of pixels arrayed in a longitudinal direction of the image display device containing the driver circuit. The voltage supply electrode 92 is connected to several (in FIG. 1, three) of the terminals 91 arrayed in continuous form, and the voltage supply electrode 93 is connected to one terminal 91 located at a side approximately opposite to the terminals 91 to which the voltage supply electrode 92 is connected.

Figure 2:
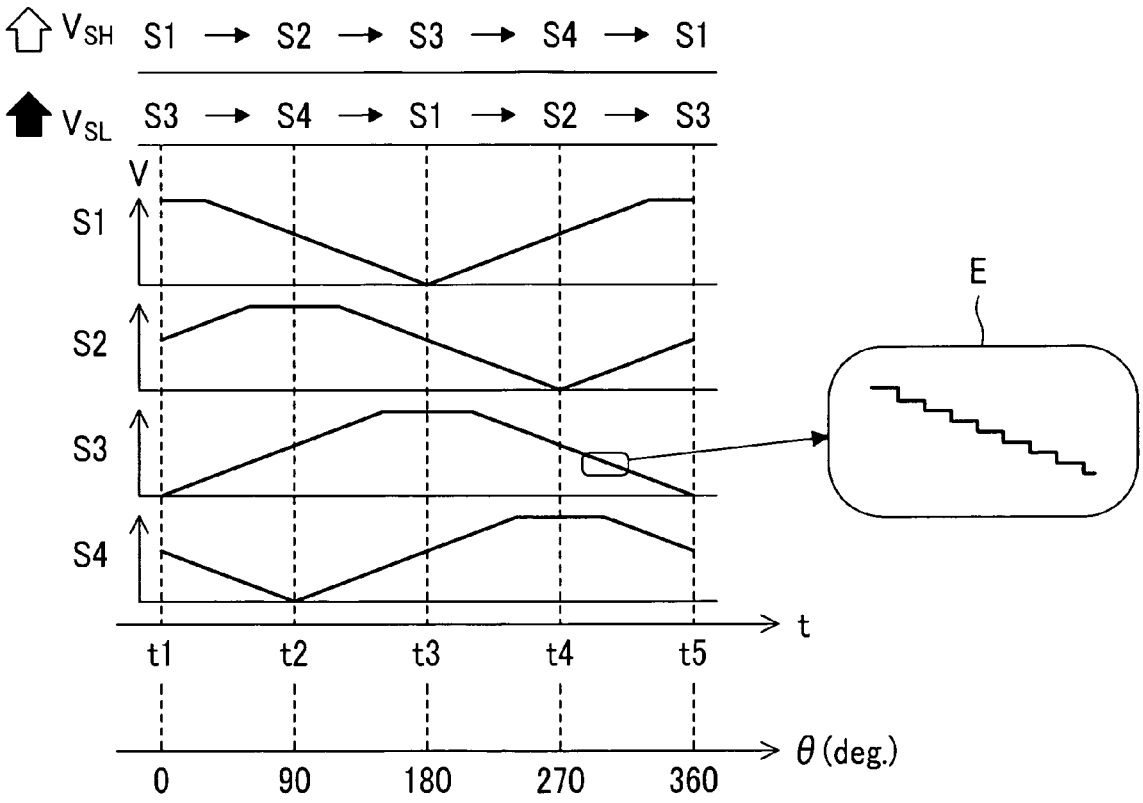
FIG. 2 shows output waveforms of signals developed at voltage supply electrode connection terminals and terminals S1 to S4 in the first embodiment of FIG. 1.

FIG. 2 shows output waveforms of signals developed at the voltage supply electrode connection terminals and at terminals S1 to S4 which form part of terminals 91. A horizontal axis "t" denotes time, and another horizontal axis "θ" denotes a phase (deg.) of the waveform. At time "t1", the voltage supply electrode 92 is connected to the terminal S1 and the terminals located anterior and posterior thereto, and the voltage supply electrode 93 is connected to the terminal S3. The maximum voltage $V_{SH}$ is developed at the terminal S1, the minimum voltage $V_{SL}$ is developed at the terminal S3, and a voltage obtained by dividing the maximum voltage $V_{SH}$ and the minimum voltage $V_{SL}$ by a value of the loop-form resistor 90 is developed at the terminal S2. The voltage-dividing ratio equals a ratio between a distance from the terminal S2 to the terminals to which the voltage supply electrode 92 is connected, and a distance from the terminal S2 to the terminal to which the voltage supply electrode 93 is connected. The same also applies to the voltage developed at the terminal S4.

As time elapses, connection positions of the voltage supply electrodes 92 and 93 with respect to the associated terminals 91 are sequentially shifted at the same rate, as indicated by arrows A and B in FIG. 1. Accordingly, voltage increases in proportion to the elapse of time at the terminals 91 where the connection position of the voltage supply electrode 93 becomes distant therefrom and where the connection position of the voltage supply electrode 92 becomes close thereto. Conversely, the voltage decreases in proportion to the elapse of time at the terminals 91 where the connection position of the voltage supply electrode 93 becomes close thereto and where the connection position of the voltage supply electrode 92 becomes distant therefrom.

Since the shifting of the voltage supply electrodes 92 and 93 is discontinuous, voltage changes at the terminals 91 to which the electrodes are actually connected will, strictly, be such stepped changes that are shown in an enlarged diagram E. The voltage changes at the terminals 91, however, can be regarded as linear, by arraying a sufficiently large number of terminals 91 for more minute stepping of the changes or by connecting a capacitor to all terminals 91 and blunting the stepped waveform.

During a time period from "t1" to "t5", when the shifting of the voltage supply electrodes 92 and 93 in connection position walks through all terminals 91 on the loop-form resistor 90, a triangular wave covering the walk-through period is developed at the terminal S1. A triangular wave of the same waveform as that of the wave developed at S1 occurs at the terminals S2 to S4, but temporal (time-varying) phases of the triangular waves developed at S2 to S4 are different from one another. The triangular wave developed at the terminal S2 has a phase 90 degrees behind that of the triangular wave developed at the terminal S1. The triangular wave developed at the terminal S3 has a phase 180 degrees behind that of the triangular wave developed at the terminal S1. The triangular wave developed at the terminal S4 has a phase 270 degrees behind that of the triangular wave developed at the terminal S1.

These indicate that the triangular waves having temporal phases associated with spatial phases of the terminals S1 to S4 on the loop-form resistor 90 of FIG. 1 are developed on the terminals S1 to S4. Similarly, a triangular wave having a temporal phase associated with a spatial phase of the particular terminal on the loop-form resistor 90 is also developed on all other terminals 91.

As can be seen from the above, a plurality of triangular-wave voltage waveforms each with a different phase can be generated by combining the loop-form resistor 90 and the two voltage supply electrodes, 92 and 93. A connection relationship between the voltage supply electrodes 92 and 93 and the terminals 91 can be easily changed using the switches each formed of thin-film transistors. At this time, since each thin-film transistor is used only as a switch function, it suffices just to assign an ON/OFF function to the transistor. Even if thin-film transistors are used that are nonuniform or variant in characteristics, therefore, triangular-wave voltage waveforms stabilize in accuracy.

Figure 20:
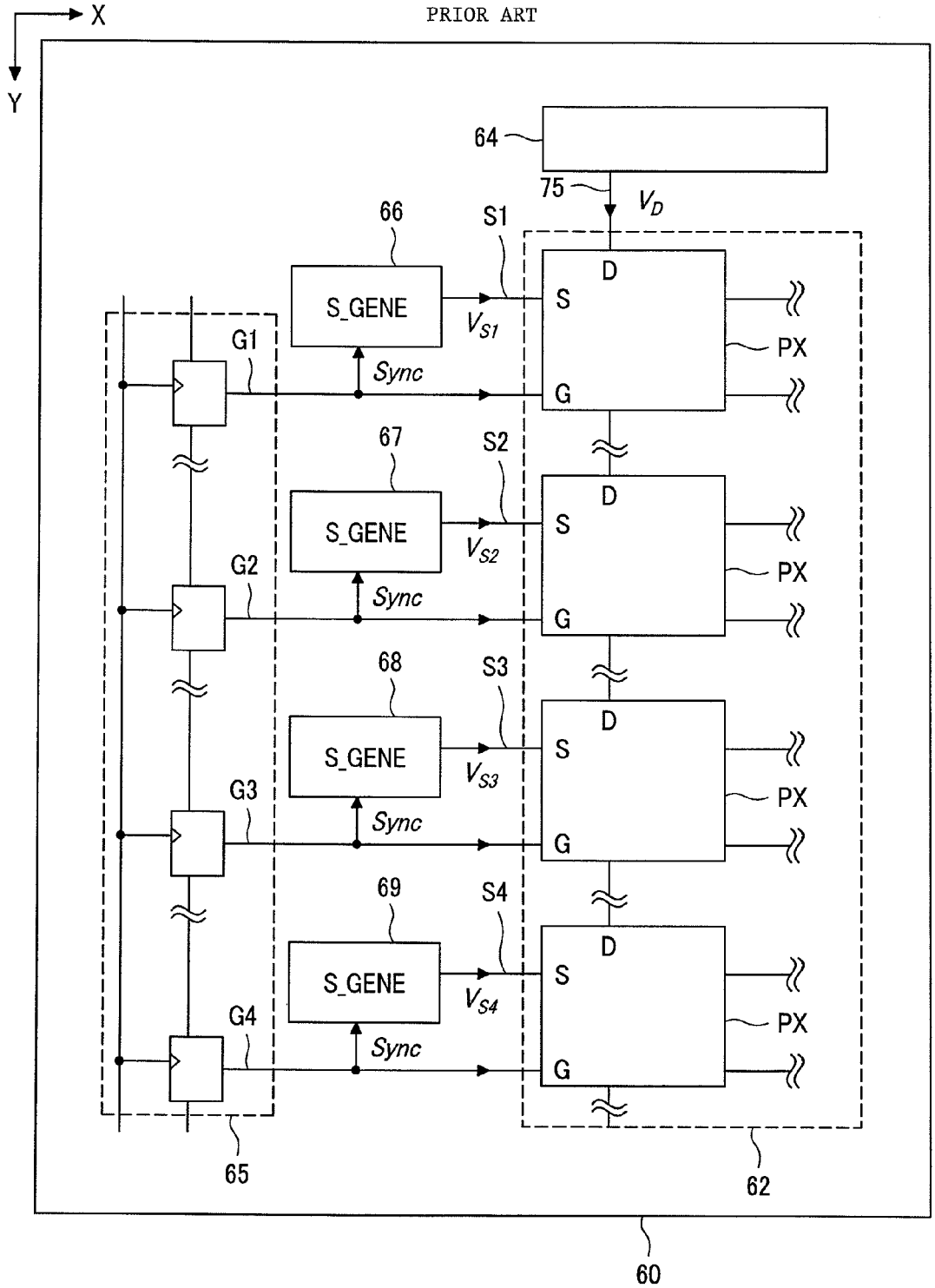
FIG.20 PRIOR ART
FIG. 20 is a diagram showing a configuration of a conventional image display device.
Figure 21:
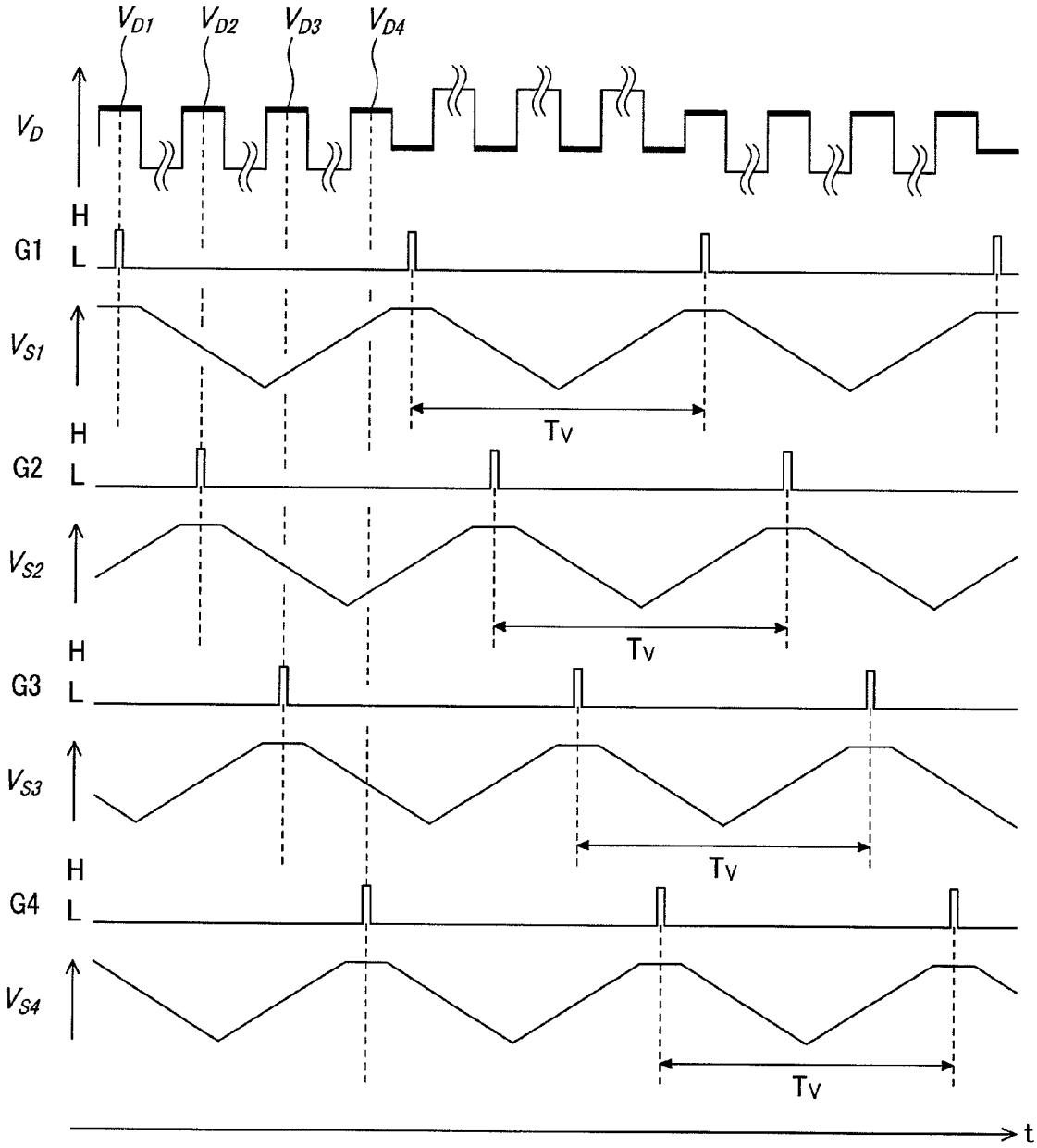
FIG.21 PRIOR ART
FIG. 21 shows voltage waveforms of the data driver LSI, scanning circuit, and waveform generators shown in FIG. 20.

The driver circuit of the present embodiment can include only the loop-form resistor 90 and the thin-film transistors constituting the voltage supply electrodes 92 and 93. When viewed in perspective of circuit scale, therefore, the circuit area required in the driver circuit is reduced significantly, compared with the signal generators 66 to 69 that have been required for each gate line as shown in FIG. 20.

Supplying to the image display device the plurality of triangular-wave voltage waveforms developed with different phases at the terminals 91 on the loop-form resistor 90 of FIG. 1 makes it possible for all pixel circuits to receive a triangular-wave voltage waveform synchronous with a pulse of the scanning circuit.

Second Embodiment

Figure 3:
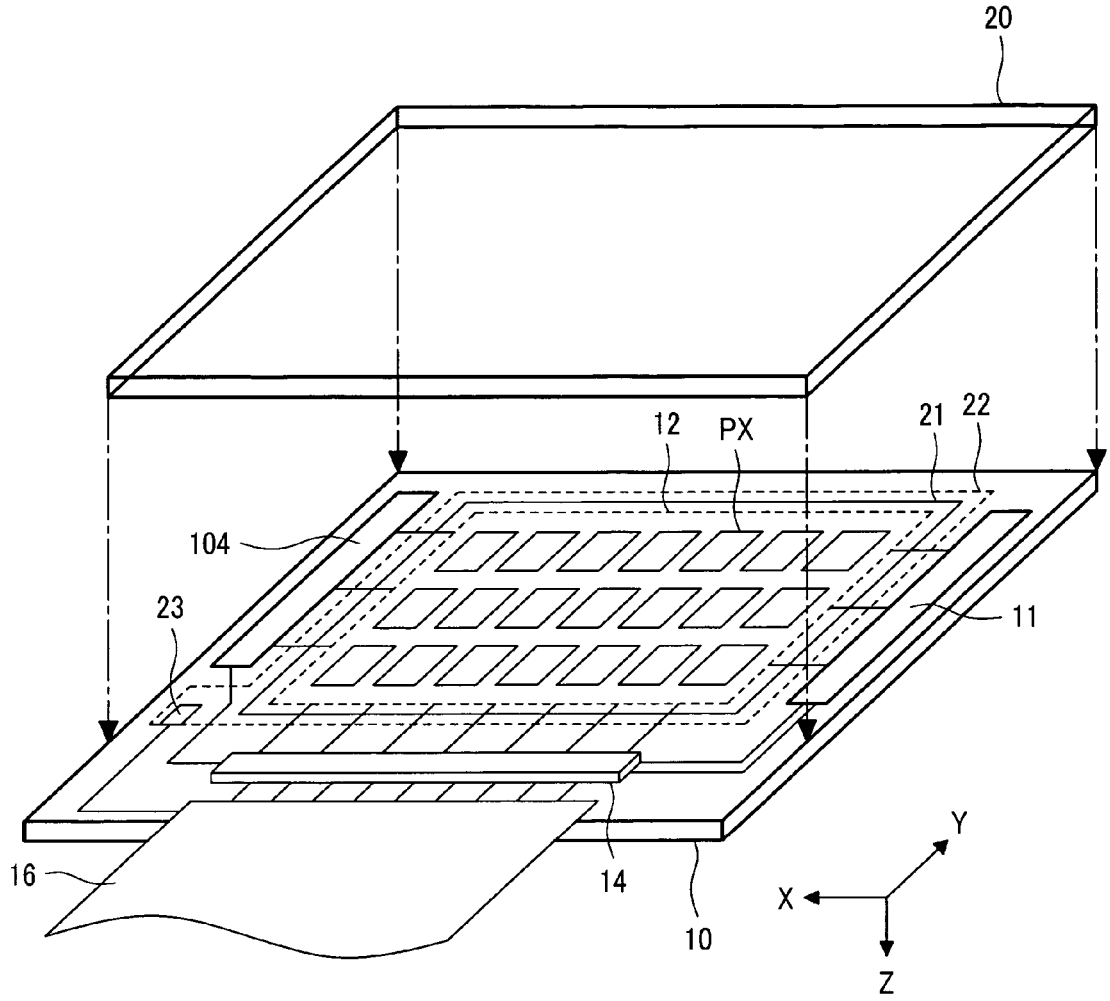
FIG. 3 is a configuration diagram showing a second embodiment of an image display device according to the present invention.

FIG. 3 shows a second embodiment of an image display device, inclusive of a driver circuit mounted therein, according to the present invention. A plurality of pixel circuits PX each formed using thin-film transistors are formed in matrix form in an image display region 12 on the surface of a transparent glass substrate 10. In FIG. 3, only ten circuits in all, seven in an X-direction and three in a Y-direction, are shown as pixel circuits PX in order to provide ease of viewing the drawing. The actual number of pixel circuits arrayed in a general image display device, however, amounts to more than several hundreds in both longitudinal and lateral directions. In a color image display device of a resolution level equivalent to that of a VGA (Video Graphics Array), the number of pixel circuits PX in the X-direction is 640×3 (RGB)=1,920, and the number of pixel circuits PX in the Y-direction is 480.

A light-emitting organic film 21 is formed on the display region 12 by chemical vapor deposition. A common electrode 22 is further formed on the light-emitting organic film 21 by chemical vapor deposition technique. The glass substrate 10 has a transparent glass substrate 20 laminated thereon to prevent the light-emitting organic film from reacting with the moisture and oxygen contained in the atmosphere. A desiccant for absorbing the moisture may be attached to the underside of the glass substrate 20.

When the pixel circuits PX generate a voltage based on a voltage of the common electrode, the light-emitting organic film 21 sandwiched between the glass substrates 10 and 20 is impressed with an electric current and emits light. Images can be displayed by conducting independent quantitative control of electric currents supplied from the pixel circuits PX, for each circuit PX. In addition, color images can be displayed by depositing light-emitting organic films each of which emits light of a different color according to pixel circuit PX. Since the light emitted from the light-emitting organic film 21 penetrates through the glass substrate 10, the image displayed can be viewed from a Z-direction. Furthermore, the image displayed can also be viewed from a direction opposite to the Z-direction, by using a light-transmitting material as the common electrode 22 or by reducing the common electrode 22 in film thickness.

In a peripheral section of the display region, a waveform generator 11 for supplying a driving signal to the pixel circuits PX, and a scanning circuit 104 are formed on the glass substrate 10 by use of thin-film transistors. Driver LSI 14 for supplying to the pixel circuits PX a voltage signal associated with an image signal is also mounted on the glass substrate 10. An FPC (Flexible Printed Circuit) 16 is mounted on one side of the glass substrate 10, and through the FPC 16, an image signal, a control signal, and a power supply voltage are supplied from an application which is installed in the image display device. A negative-side voltage for activating the light-emitting organic film 21 is supplied to the common electrode 22 through a contact 23 provided on the glass substrate 10. An associated positive-side voltage is supplied to all pixel circuits PX through wiring which, although not shown in the drawing, is provided on the glass substrate 10.

Figure 4:
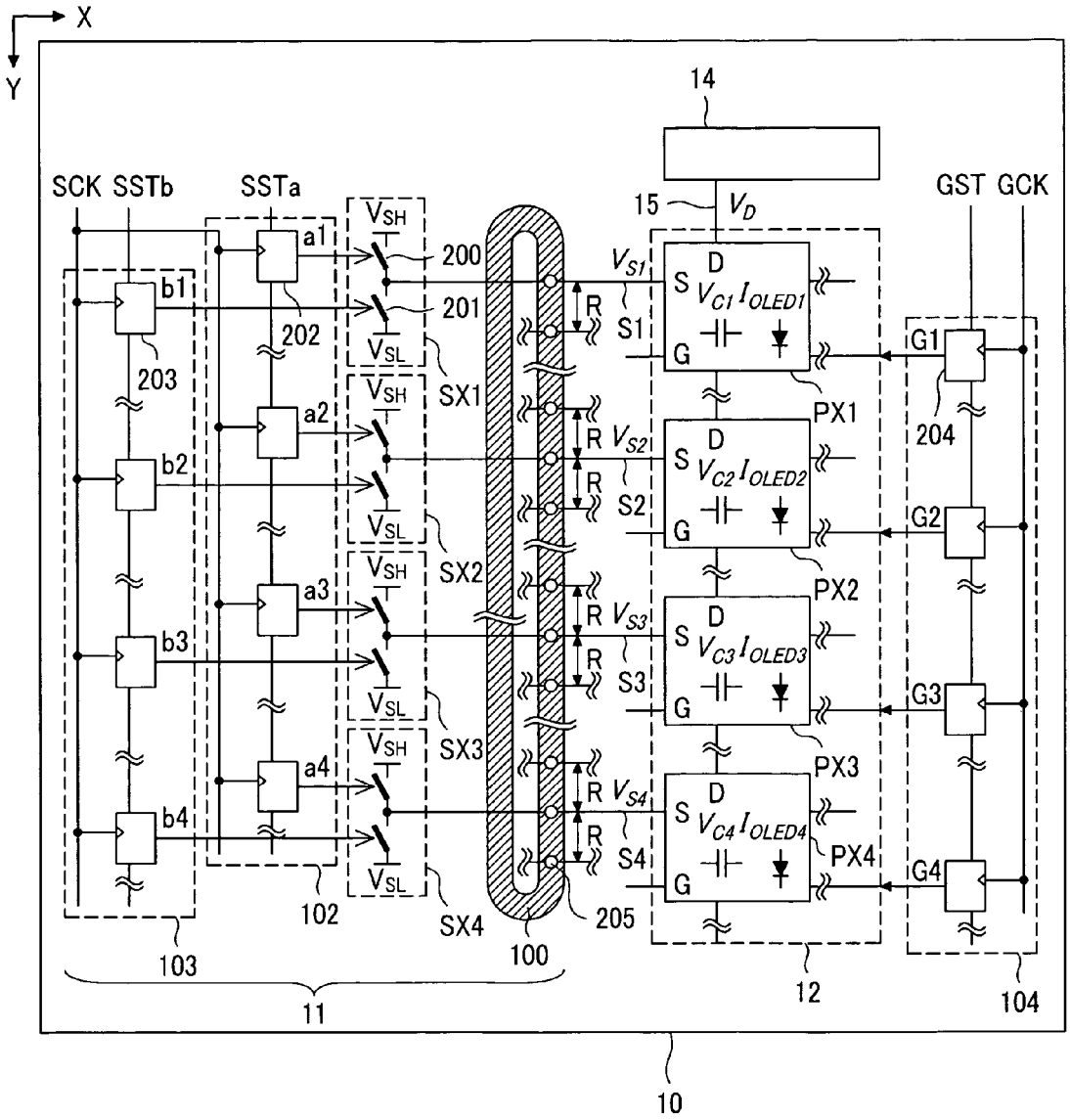
FIG. 4 is a diagram that shows composition of a driver circuit built into an image display device according to the present invention.

FIG. 4 shows another example of composition of the driver circuit built into the image display device of the present embodiment. A waveform generator 11 and a scanning circuit 104 are arranged around a display region 12 on a glass substrate 10. Although only five circuits in all, one in an X-direction and four in a Y-direction, are shown as pixel circuits PX in FIG. 4 in order to provide ease of description, the actual number of pixel circuits PX arrayed in a general image display device amounts to more than several hundreds in both longitudinal and lateral directions. In order to distinguish the four pixel circuits PX from one another, a reference number from PX1 to PX4 is assigned to each in FIG. 4.

The waveform generator 11 includes one loop-form resistive wiring section 100, a plurality of voltage supply switches SX, and two shift registers, 102 and 103. The waveform generator 11 has as many voltage supply switches SX as there actually are pixel circuits PX in the Y-direction (only four of the switches SX are shown in the drawing). In order to distinguish the four voltage supply switches SX from one another, a reference number from SX1 to SX4 is assigned to each in FIG. 4. All voltage supply switches SX are constituted by a switch 200 which supplies a maximum voltage $V_{SH}$ of an output waveform, and a switch 201 which supplies a minimum voltage $V_{SL}$ of an output waveform.

The shift register 102 is constituted by connecting latches 202 in series to one another. The shift register 103 is likewise constituted by connecting latches 203 in series to one another. Both the shift register 102 and the shift register 103 have as many latch stages as there actually are pixel circuits PX in the Y-direction (in the drawing, both registers include only four of the latch stages). The shift register 102 receives logical data input from an input line SSTa, and the input logical data shifts each latch 202 in synchronization with a clock signal input to an input line SCK.

Each latch 202 has one output line (a1-a4), and the latch 202 supplies internally stored logical data to an associated voltage supply switch SX and controls ON/OFF operation of the switch 201 located inside the voltage supply switch SX. The shift register 103 receives logical data input from an input line SSTb, and the input logical data shifts each latch 203 in synchronization with a clock signal input to the input line SCK.

Each latch 203 has one output line (b1-b4), and the latch 203 supplies internally stored logical data to an associated voltage supply switch SX and controls ON/OFF operation of the switch 201 located inside the voltage supply switch SX.

A plurality of connection nodes 205 are arranged on the loop-form resistive wiring 100. The number of connection nodes 205 is equal to that of pixel circuits PX in the Y-direction (only 11 of the connection nodes 205 are shown). All connection nodes are arranged on the loop-form resistive wiring so as to obtain the same resistance value R between adjacent connection nodes 205. All connection node 205 are connected to respective output terminals of the voltage supply switches SX and to waveform input terminals S of the pixel circuits PX.

In FIG. 4, of all connection nodes 205, only four connection nodes 205 connected to triangular-wave signal lines S1 to S4 have their connection relationship with respect to the output terminals of the voltage supply switches SX1 to SX4 and the waveform input terminals S of the pixel circuits PX1 to PX4. Description of a connection relationship of the remaining connection nodes 205 with respect to the above output and input terminals is omitted.

The scanning circuit 104 is constituted as a shift register circuit having latches 204 connected in series to one another. The scanning circuit 104 has as many latch stages as there actually are pixel circuits PX in the Y-direction (in the drawing, only four of the latch stages are shown). The scanning circuit 104 receives logical data input from an input line GST, and the input logical data shifts each latch 204 in synchronization with a clock signal input to an input line GCK. Each latch 204 has one output line, and the latch 204 supplies internally stored logical data to a scanning signal input terminal G of a pixel circuit PX for a particular column through a gate line G1, G2, G3, or G4 and controls operation of the pixel circuit PX for the column.

The pixel circuits PX arranged in matrix form have respective data input terminals D connected to one another through a common data line 15 for each row, and an image signal voltage $V_D$ with image information is supplied from driver LSI 14 to the data line 15. Although only one data line 15 is shown in FIG. 4, the driver circuit has as many data lines 15 as there actually are pixel circuits PX in the X-direction.

Figure 19:
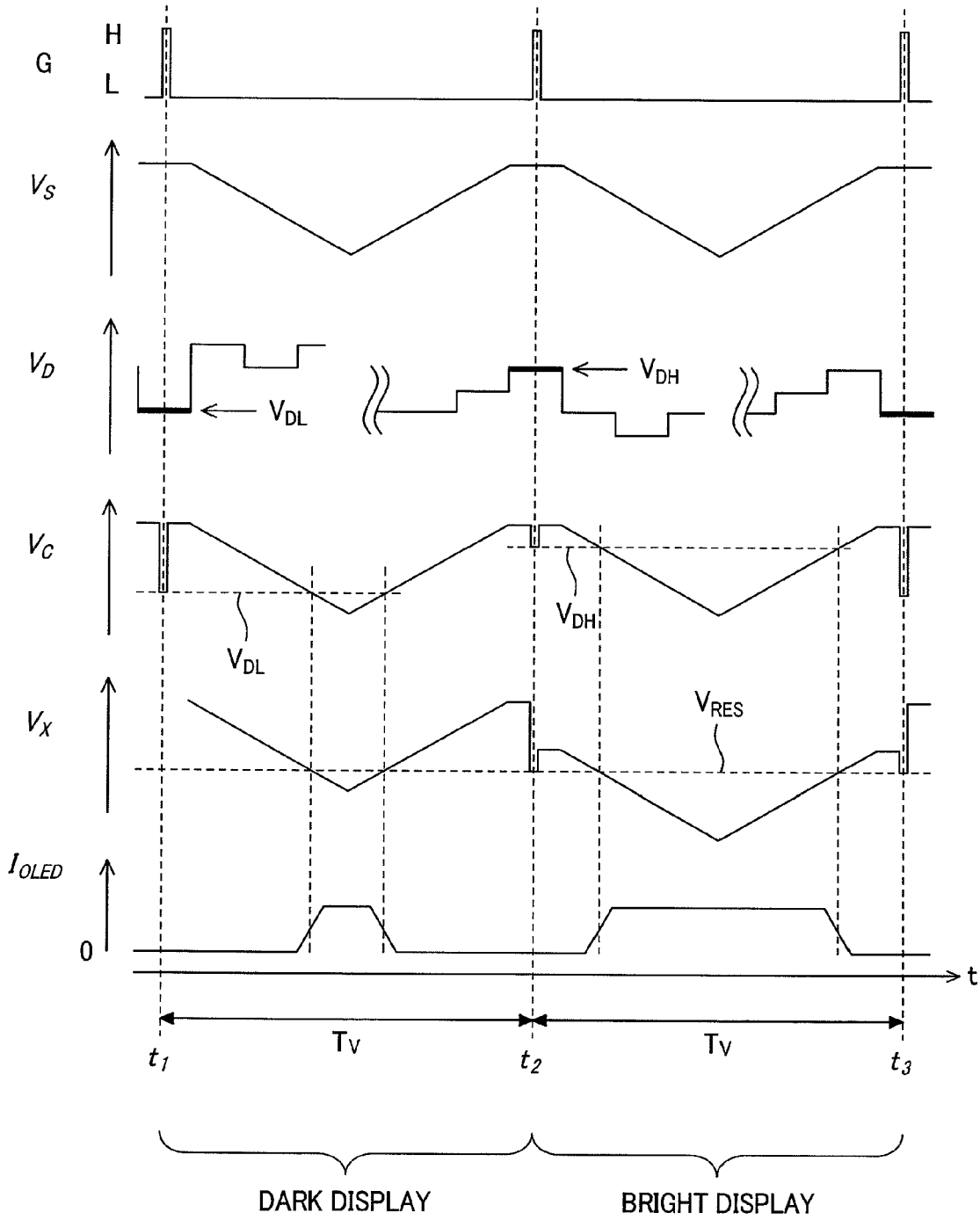
FIG.19 PRIOR ART
FIG. 19 shows examples of operation waveforms of various sections in the pixel circuit PX of FIG. 17A.

The circuit composition of the pixel circuits PX is the same as that shown in FIG. 17 of a conventional example, and the operation of the pixel circuits PX is the same as that shown in FIG. 19 of another conventional example and in FIG. 3.

Figure 5:
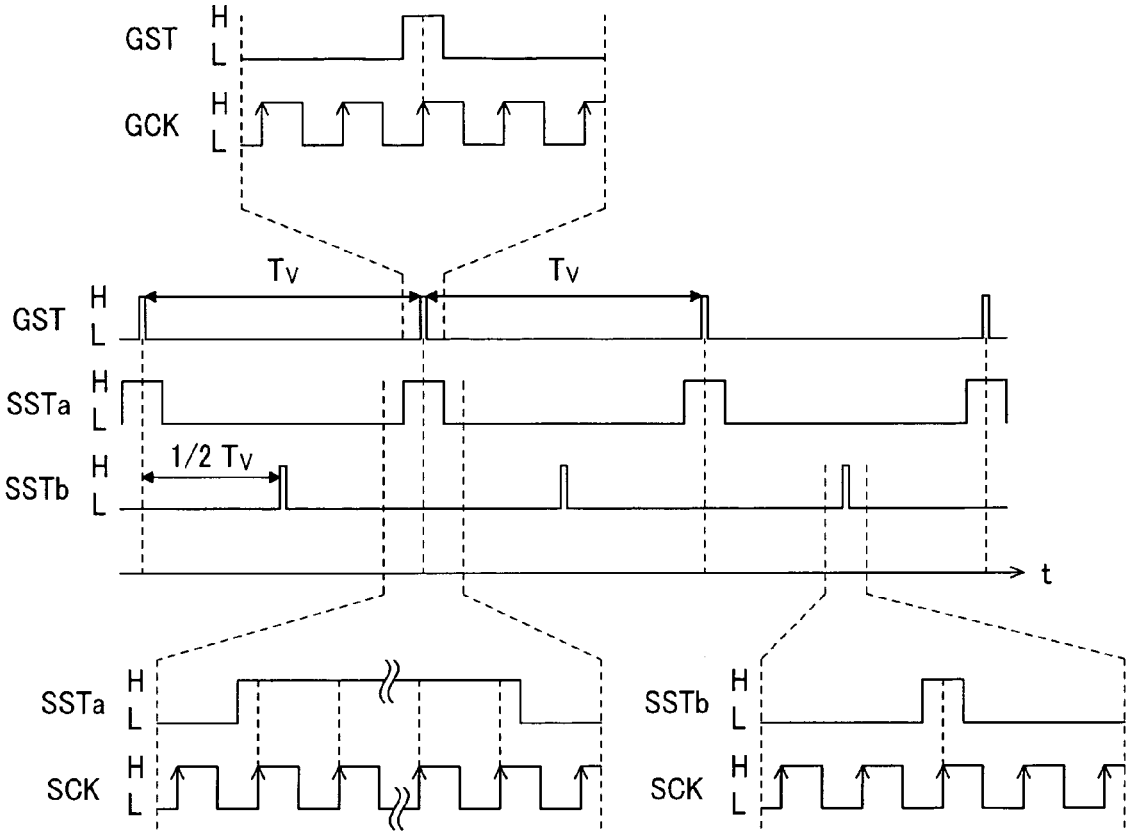
FIG. 5 shows input signal waveforms for driving the shift registers and scanning circuit shown in FIG. 4.

Input signal waveforms for driving the shift registers 102, 103 and the scanning circuit 104, are shown in FIG. 5. A synchronizing clock with a cycle time equivalent to a horizontal scanning period is constantly input to the input line GCK of the scanning circuit 104, and one pulse is input for each vertical scanning period $T_V$ (e.g., 1/60 of a second) to the input line GST of the scanning circuit 104 in synchronization with the clock of the input line GCK. The pulse input to GST is made to include one of rising edges of the clocks input to GCK.

A clock which is extremely close to the clock of the input line GCK of the scanning circuit 104 in terms of frequency and with which as many pulses as there actually are latch stages in the shift registers 102 and 103 are input at equal time intervals during a vertical scanning period $T_V$ is constantly input to the clock input line SCK of the shift registers 102 and 103. One pulse is input for each vertical scanning period $T_V$ to the input line SSTb of the shifter register 103 in synchronization with the clock of the input line SCK. The pulse that is input to SSTb is made to include one of rising edges of the clocks input to SCK. Also, supply timing of the pulse input to SSTb is delayed behind that of the input pulse of GST by approximately half ($T_V/2$) of the vertical scanning period $T_V$.

One pulse is input for each vertical scanning period $T_V$ to the input line SSTa of the shifter register 102 in synchronization with the clock of the input line SCK. The pulse that is input to SSTa is made to include a plurality of continuous rising edges of the clock input to SCK. Also, the pulse input to SSTa is made to include a time during which a pulse is input to GST.

Figure 6:
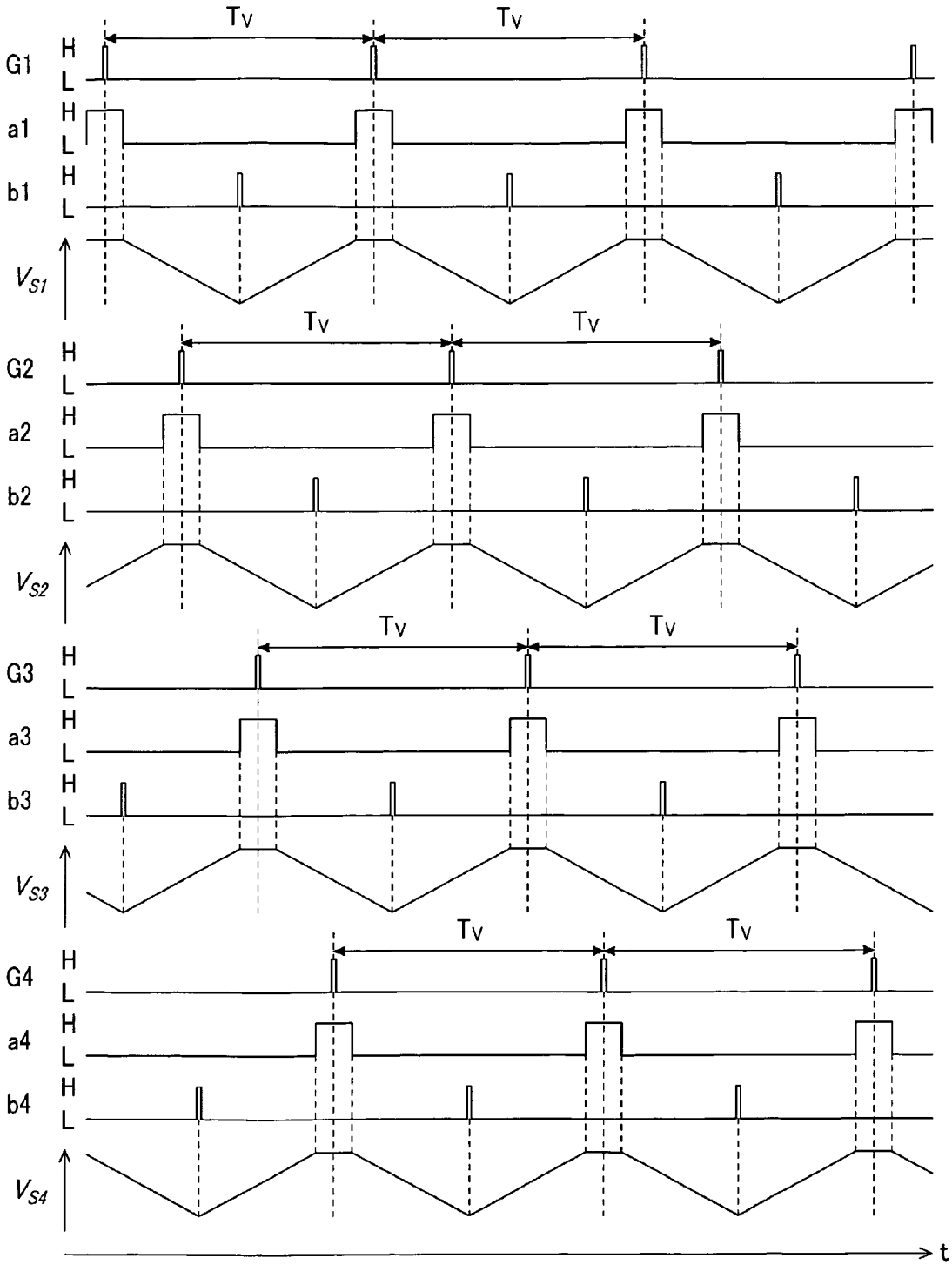
FIG. 6 shows output waveforms of the shift registers and scanning circuit of FIG. 4, and voltage waveforms of triangular-wave signal lines.

Output waveforms of the shift registers 102, 103 and of the scanning circuit 104, and voltage waveforms of the triangular-wave signal lines S1 to S4 are shown in FIG. 6. When the scanning circuit 104 and the shift registers 102, 103 operate to perform respective shift functions, a waveform of the same shape as that of the input waveform of GST is output to the output gate lines G1 to G4. Likewise, a waveform of the same shape as that of the input waveform of SSTa is output to the output lines a1 to a4, and a waveform of the same shape as that of the input waveform of SSTb is output to the output lines b1 to b4.

Differences in waveform between the output gate lines G1 to G4, between the output lines a1 to a4, and between the output lines b1 to b4 appear only as differences in phase between the waveforms. Pulses are supplied from the shift registers 102 and 103 to the voltage supply switches 201, and when these supply destinations shift with time, the voltage supply switch 201 that is functioning to supply the maximum voltage $V_{SH}$ and the voltage supply switch 202 that is functioning to supply the minimum voltage $V_{SL}$ shift the connection nodes 205 of the loop-form resistive wiring 100 with time.

Consequently, as can be understood from the present embodiment, triangular-wave voltage waveforms $V_{S1}$, to $V_{S4}$ are output to the triangular-wave signal lines S1 to S4. Since phases of the triangular-wave voltage waveforms $V_{S1}$ to $V_{S4}$ are equal to those of the output lines a1 to a4 and b1 to b4, the phases of the triangular-wave voltage waveforms $V_{S1}$ to $V_{S4}$ can be matched to those of the output gate lines G1 to G4 in the scanning circuit 104. A triangular-wave voltage waveform synchronous with the scanning pulse is supplied to all pixels PX1 to PX4.

Figure 7:
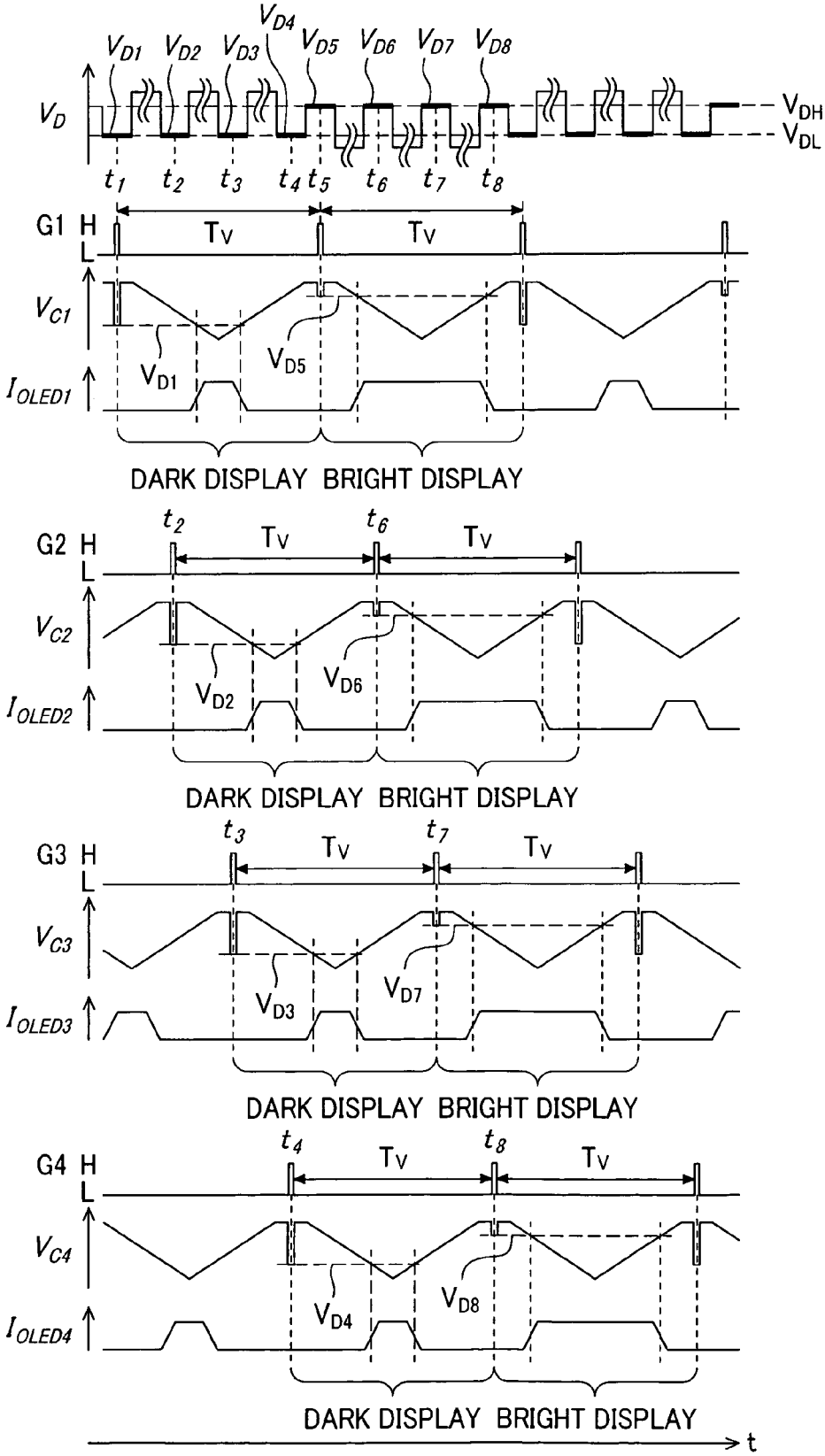
FIG. 7 shows operation waveforms of the image display device according to the second embodiment of the present invention.

Operation waveforms of the image display device according to the present embodiment are shown in FIG. 7. FIG. 7 shows image signal voltages $V_D$ that a data driver 14 supplies to the data line 15, states of the gate lines G1 to G4, voltages $V_{C1}$ to $V_{C4}$ developed in a node located to the left of capacitors C within the pixel circuits PX1 to PX4, and currents $I_{OLED1}$ to $I_{OLED4}$ flowing into EL elements of the pixel circuits PX1 to PX4. The data driver LSI 14 sequentially supplies the image signal voltages $V_{D1}$ to $V_{D4}$ to the data line 15 in synchronization with pulses developed at the gate lines G1 to G4 during a time period of "t1" to "t4". In timing of the pulses of the gate lines G1 to G4, the pixel circuits PX1 to PX4 supply the image signal voltages $V_{D1}$ to $V_{D4}$ respectively to the capacitors C within each pixel circuit.

During a time of a pulse being absent on the gate lines, the voltages $V_{C1}$ to $V_{C4}$ of the capacitors C within the pixel circuits PX1 to PX4 develop the triangular-wave voltage waveforms $V_{S1}$, to $V_{S4}$. During a time of the triangular-wave voltage waveforms $V_{S1}$ to $V_{S4}$ being lower than the image signal voltages $V_{D1}$ to $V_{D4}$ supplied to the pixel circuits PX1 to PX4, the currents $I_{OLED1}$ to $I_{OLED4}$ flow into the EL elements, and during a time of the triangular-wave voltage waveforms $V_{S1}$ to $V_{S4}$ being higher, the currents $I_{OLED1}$ to $I_{OLED4}$ do not flow.

The above description assumes an example of the image signal voltages $V_{D1}$ to $V_{D4}$ being each relatively low voltages $V_{DL}$, and in this example, the time during which the currents $I_{OLED1}$ to $I_{OLED4}$ flow becomes relatively short and the image display device can display a dark image. The above description also assumes an example of image signal voltages $V_{D5}$ to $V_{D8}$ being relatively high voltages $V_{DH}$, and in this example, the time during which the currents $I_{OLED1}$ to $I_{OLED4}$ flow becomes relatively long and the image display device can display a bright image.

Figure 8:
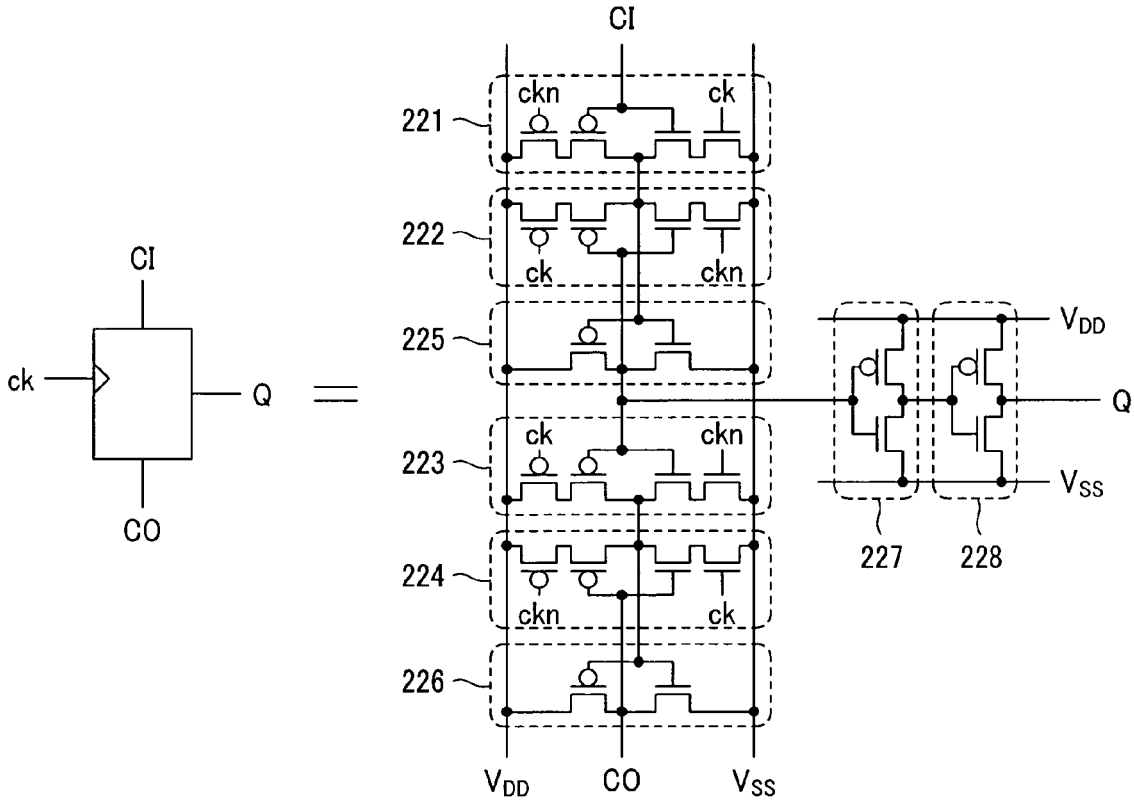
FIG. 8 is a circuit diagram of latches which constitute the shift registers and scanning circuit of FIG. 4.

FIG. 8 shows a circuit diagram of the latches 202 to 204 constituting the shift registers 102, 103 and the scanning circuit. Each latch circuit includes clocked inverters 221 to 224 each constituted by two n-channel TFTs and two p-channel TFTs, and inverters 225, 226 each constituted by one n-channel TFT and one p-channel TFT. If necessary, inverters 227, 228 for current amplification are connected to an output Q. Logic of the output Q can be inversed by adjusting the number of inverter stages to an odd number. Reference symbol "ck" denotes a clock signal, and "ckn" denotes an input of an inversion signal of the clock signal. The "ckn" signal can be easily generated by inverting "ck" using an inverter. Reference symbol $V_{DD}$ denotes a power supply voltage, and $V_{SS}$ denotes a grounding voltage.

Figure 9:
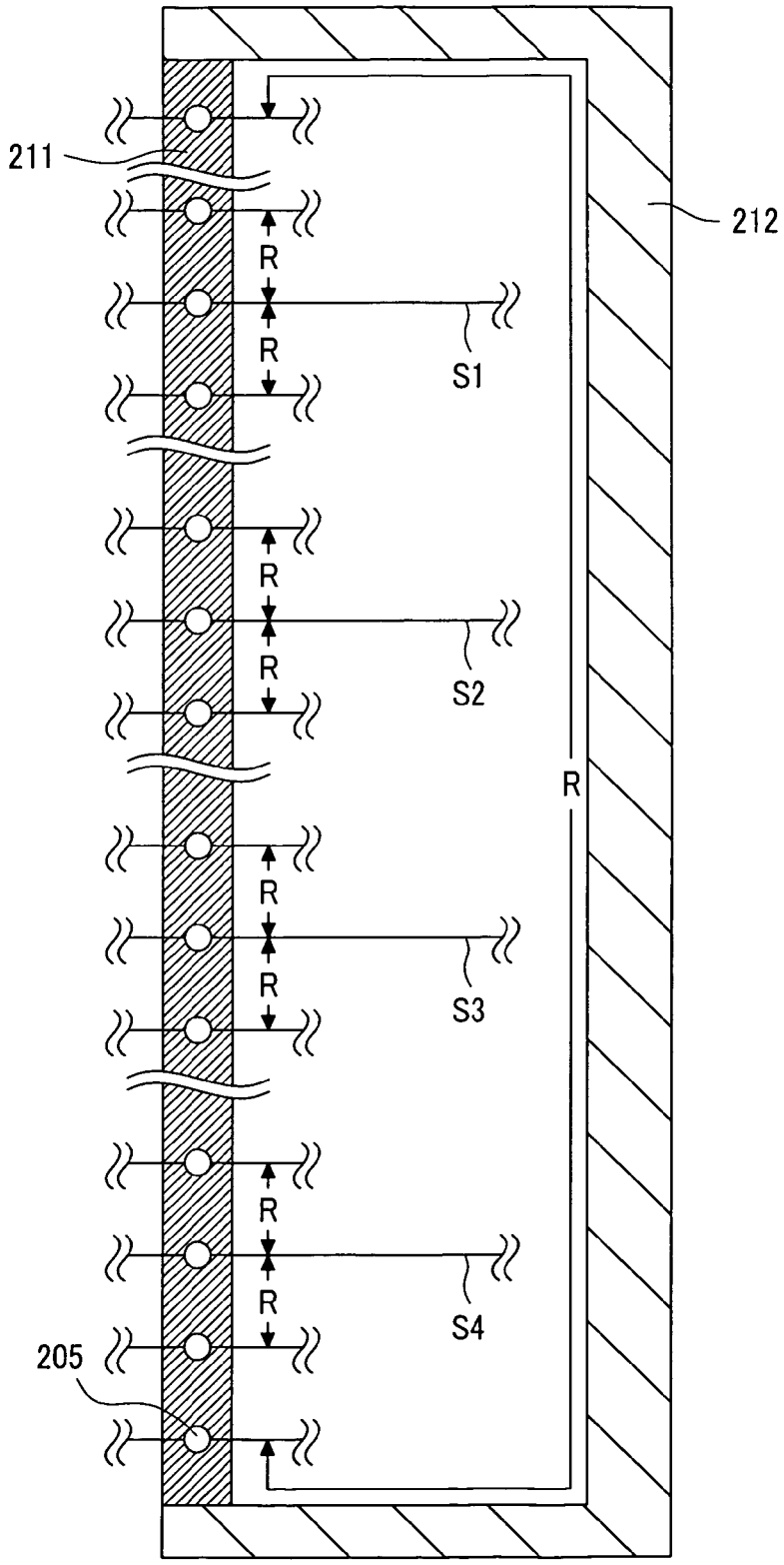
FIG. 9 is a diagram showing a second structure of loop-form resistive wiring.

A second structure of loop-form resistive wiring is shown in FIG. 9. The loop-form resistive wiring shown in FIG. 9 can be used instead of the loop-form wiring resistor 100 of FIG. 4. The loop-form resistive wiring in FIG. 9 includes linear resistive wiring 211 and wiring 212 which has a sheet resistance value smaller than that of the wiring 211. The linear resistive wiring 211 and the wiring 212 are each connected at both ends to form a loop. Connection nodes 205 are arranged on the linear resistive wiring 211 so that a resistance value between any two of the connection nodes is an approximately constant resistance value R. Additionally, a resistance value between two connection nodes 205 arranged across the linear resistive wiring 211 is made approximately equal to the resistance value R by the wiring 212 whose sheet resistance value is smaller than that of the wiring 211.

The second structure of the loop-form resistive wiring has an advantage in that since connection nodes can be arranged in line on the loop-form resistive wiring 211, each connection node can be lined up in a Y-direction of each pixel circuit PX.

Figure 10:
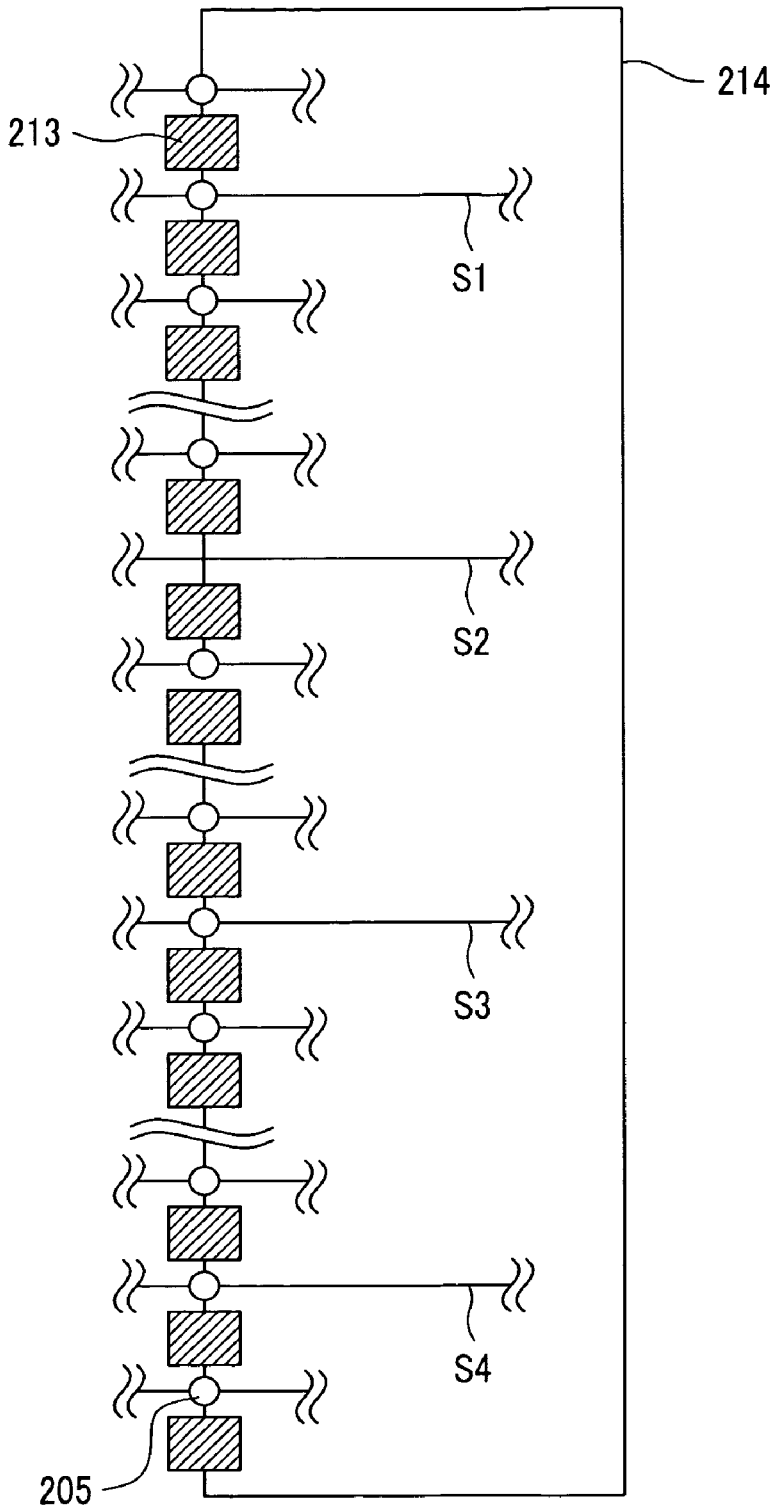
FIG. 10 is a diagram showing a third structure of loop-form resistive wiring.

A third structure of loop-form resistive wiring is shown in FIG. 10. The loop-form resistive wiring shown in FIG. 10 can be used instead of the loop-form wiring resistor 100 of FIG. 4. The loop-form resistive wiring in FIG. 10 is constructed by concatenating a plurality of resistive elements 213 via wiring 214 which connects each thereof. The wiring 214 has a wiring resistance value sufficiently smaller than that of each resistive element 213. Connection nodes 205 are arranged such that one is present between two resistive elements 213. Since the resistive elements are relatively high in resistance, the third structure of the loop-form resistive wiring is particularly useful when a distance between connection nodes makes it difficult to interconnect the resistive elements by disposing these resistive elements alone.

Figure 11:
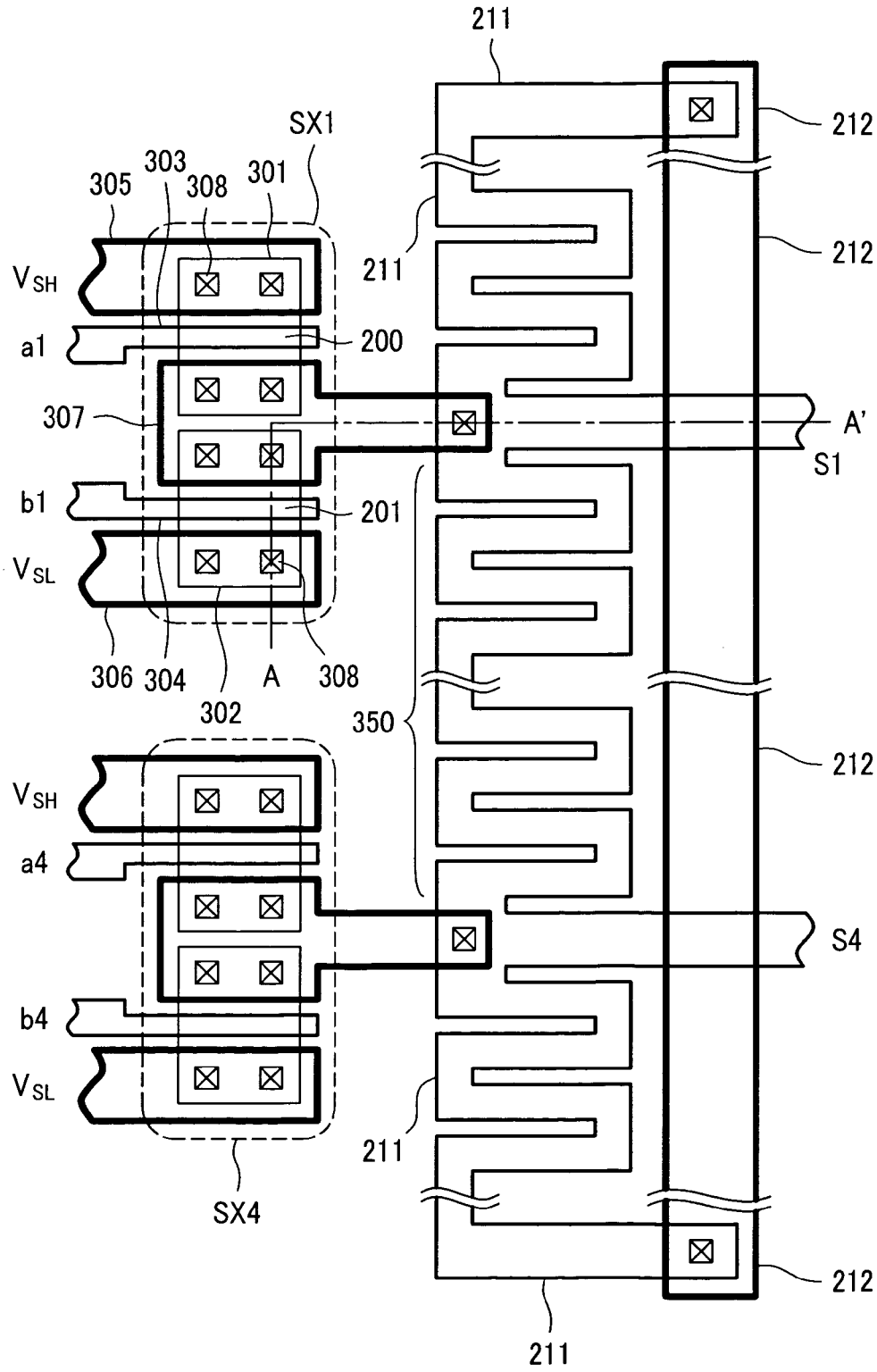
FIG. 11 is a diagram showing an example of laying out voltage supply switches and loop-form resistive wiring of the second structure.

FIG. 11 shows an example of laying out voltage supply switches SX and loop-form resistive wiring of the second structure. Internal switches 200 and 201 of each voltage supply switch SX are both constructed of one TFT. Gate electrode wiring sections 303 and 304 are formed in such a way as to overlap polycrystalline silicon films (hereinafter, referred to simply as polysilicon films) 301 and 302, respectively, and so that a gate-insulating film is interposed between the gate electrode wiring section 303, 304 and the polysilicon film 301, 302. The overlapping portion between the polysilicon film 301 and the gate electrode wiring section 303, and the overlapping portion between the polysilicon film 302 and the gate electrode wiring section 304 serve as TFTs which constitute the switches 200 and 201.

An aluminum wiring section 305 constitutes supply wiring for a maximum voltage $V_{SH}$ of a triangular-wave voltage waveform, an aluminum wiring section 306 constitutes supply wiring for a minimum voltage $V_{SL}$ of the triangular-wave voltage waveform, and an aluminum wiring section 307 constitutes output wiring of a voltage supply switch SX1. The aluminum wiring sections 305 to 307 are connected to the polysilicon film 302 through a plurality of contact holes 308. That is to say, the aluminum wiring sections 305 to 307 are connected to source and drain electrodes of each TFT.

Linear resistive wiring 211 is formed using the same wiring layer as that of the gate electrode wiring section 303, 304. If the gate electrode wiring is relatively small in sheet resistance value and needs a long wiring run to obtain a resistance value R, wiring length can be increased by applying a loopback structure 350 to the linear resistive wiring 211. Wiring 212 is formed using the same aluminum wiring material as used for the aluminum wiring sections 305 to 307 connected to the source and drain electrodes of each TFT. Since aluminum is a metallic material relatively low in resistivity, it is easy to reduce the wiring 212 in sheet resistance value.

Figure 12:
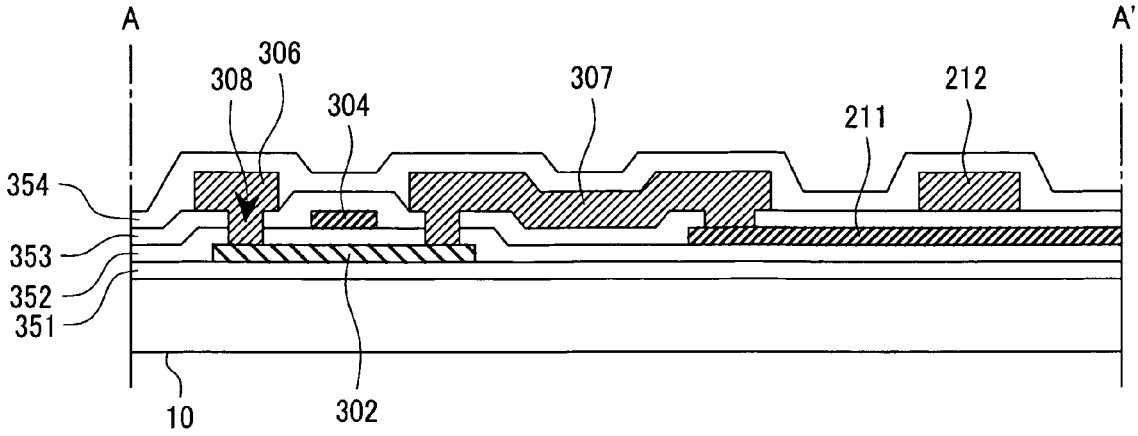
FIG. 12 is a cross-sectional structure of a region along line A-A' in FIG. 11.

A cross-sectional structure of a region along line A-A' in FIG. 11 is shown in FIG. 12. An insulating film 351 is formed on a glass substrate 10. The polysilicon film 302 that forms part of a TFT is formed on the insulating film 351. Above the polysilicon film 302, the gate electrode wiring section 304 that forms part of the TFT and the linear resistive wiring 211 are formed using the same layer with a gate-insulating film 352 interposed between the gate electrode wiring and the linear resistive wiring. Above the gate electrode wiring 304 and the linear resistive wiring 211, the aluminum wiring sections 306, 307 and the wiring 212 are formed using the same aluminum layer with an insulating film 353 interposed between the aluminum wiring sections 306, 307 and the wiring 212. An insulating film 354 is further formed over the aluminum wiring sections 306, 307 and the wiring 212. Although actually vapor-deposited on the insulating film 354, a light-emitting organic film and/or the like is omitted from FIG. 12 since the waveform generator does not use the light-emitting organic film and/or the like. Under the contact holes 308, the insulating films are holed to obtain electrical contact between the aluminum layer and the polysilicon film layer and between the aluminum layer and the gate electrode wiring. The resistance of the wiring 212 can be further reduced by forming the aluminum layer more thickly than the gate electrode wiring layer.

Figure 13:
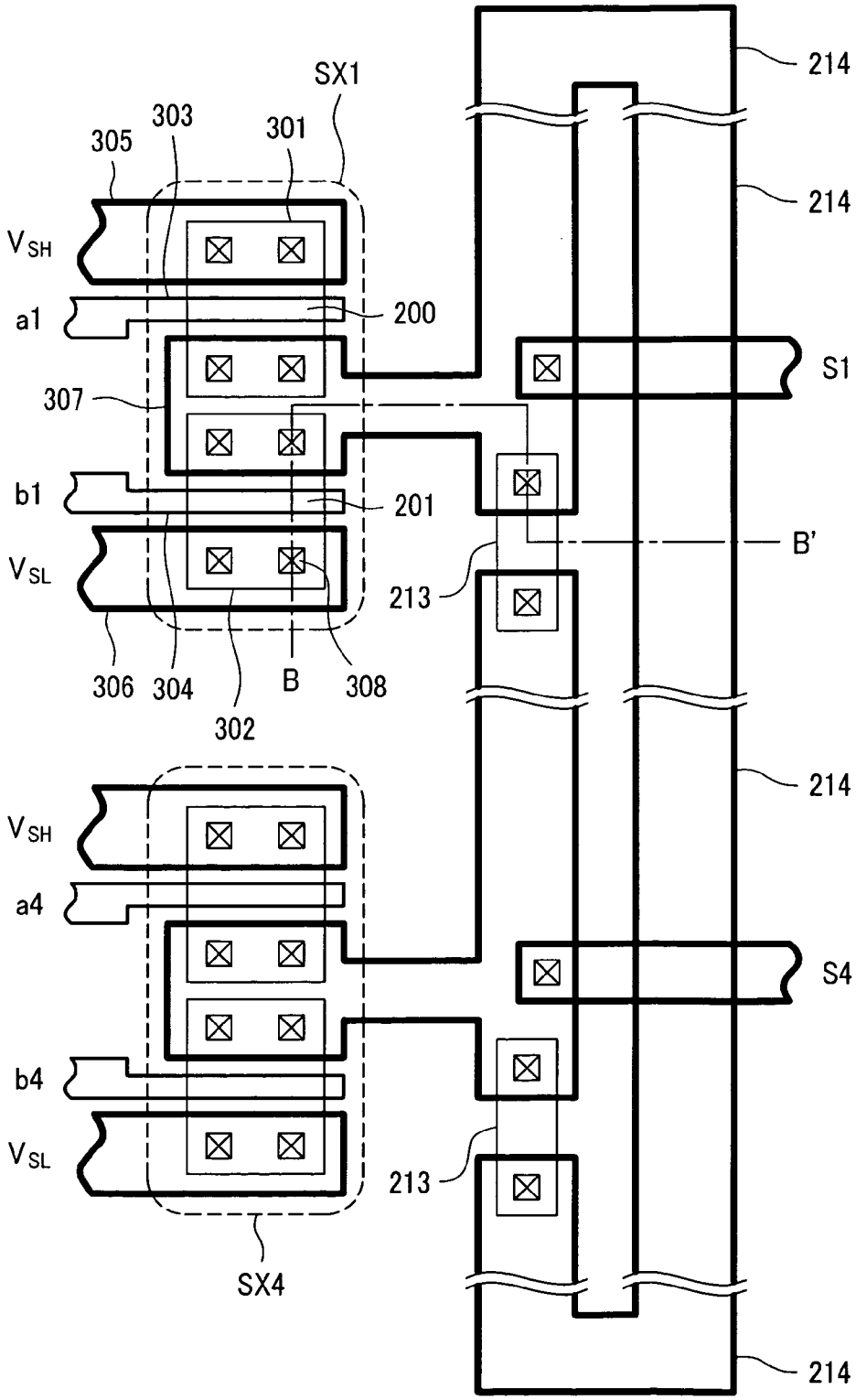
FIG. 13 is a diagram showing an example of laying out voltage supply switches and loop-form resistive wiring of the third structure.

FIG. 13 shows an example of laying out voltage supply switches SX and loop-form resistive wiring of the third structure. Constituent elements of a voltage supply switch SX1 are of the same layout as that shown in FIG. 11.

Resistive elements 213 are formed using the same polysilicon film layer as that of polysilicon films 301 and 302 which constitute internal TFTs of each voltage supply switch SX. When sheet resistance of the polysilicon films is relatively high and a short wiring run suffices to obtain a resistance value R, the resistive elements 213 are interconnected using aluminum wiring 307. Wiring 214 is formed using the same aluminum wiring material as used for aluminum wiring sections 305 to 307 each connected to source and drain electrodes of a TFT. Since aluminum is a metallic material relatively low in resistivity, it is easy to reduce the wiring 214 in sheet resistance value.

Figure 14:
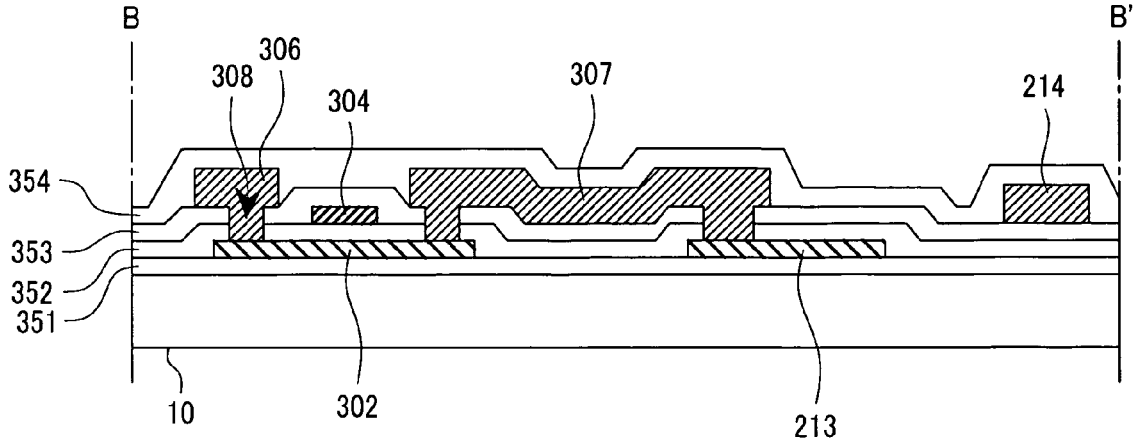
FIG. 14 is a cross-sectional structure of a region along line B-B' in FIG. 13.

A cross-sectional structure of a region along line B-B' in FIG. 13 is shown in FIG. 14. An insulating film 351 is formed on a glass substrate 10. The polysilicon film 302 that forms part of a TFT, and a resistive element 213 are formed on the insulating film 351. Gate electrode wiring 304 that forms part of the TFT is formed above the polysilicon film 302 with a gate-insulating film 352 interposed between the gate electrode wiring and the polysilicon film. Above the gate electrode wiring 304, the aluminum wiring sections 306, 307 and the wiring 214 are formed using the same aluminum layer with an insulating film 353 interposed between the aluminum wiring sections 306, 307 and the wiring 214. An insulating film 354 is further formed over the aluminum wiring sections 306, 307 and the wiring 214. Although actually vapor-deposited on the insulating film 354, a light-emitting organic film and/or the like is omitted from FIG. 14 since the waveform generator does not use the light-emitting organic film and/or the like. Under contact holes 308, the insulating films are holed to obtain electrical contact between the aluminum layer and the polysilicon film layer and between the aluminum layer and the gate electrode wiring. The resistance of the wiring 214 can be further reduced by forming the aluminum layer more thickly than the gate electrode wiring layer.

As described above, the driver circuit in the image display device of the present embodiment employs TFTs whose purposes of use are limited only to realize switch and logic circuit functions, and is able to generate triangular-wave voltage waveforms by voltage division of loop-form resistive wiring 100. As in the first embodiment, therefore, the driver circuit in the present embodiment can generate highly accurate triangular-wave voltage waveforms without using an analog amplifier.

In addition, the waveform generator 11 is simple in circuit composition and can minimize the circuit area required. The waveform generator has these characteristics since it includes one loop-form resistive wiring section, two shift registers each constituted by latches, and voltage supply switches each constituted by two TFTs (the number of voltage supply switches is equal to that of pixel circuits arranged in the Y-direction thereof).

The driver circuit in the present embodiment, therefore, makes it possible for triangular-wave voltage waveforms different from one another in phase to be supplied to the pixel circuits by using thin-film transistors, and LSI for generating the triangular-wave voltage waveforms does not need to be mounted in the image display device. Accordingly, the image display device can be manufactured at a lower cost. In addition, since the circuit area required can be minimized, the marginal region (non-display section) of the image display device can be dimensionally minimized.

Figure 15:
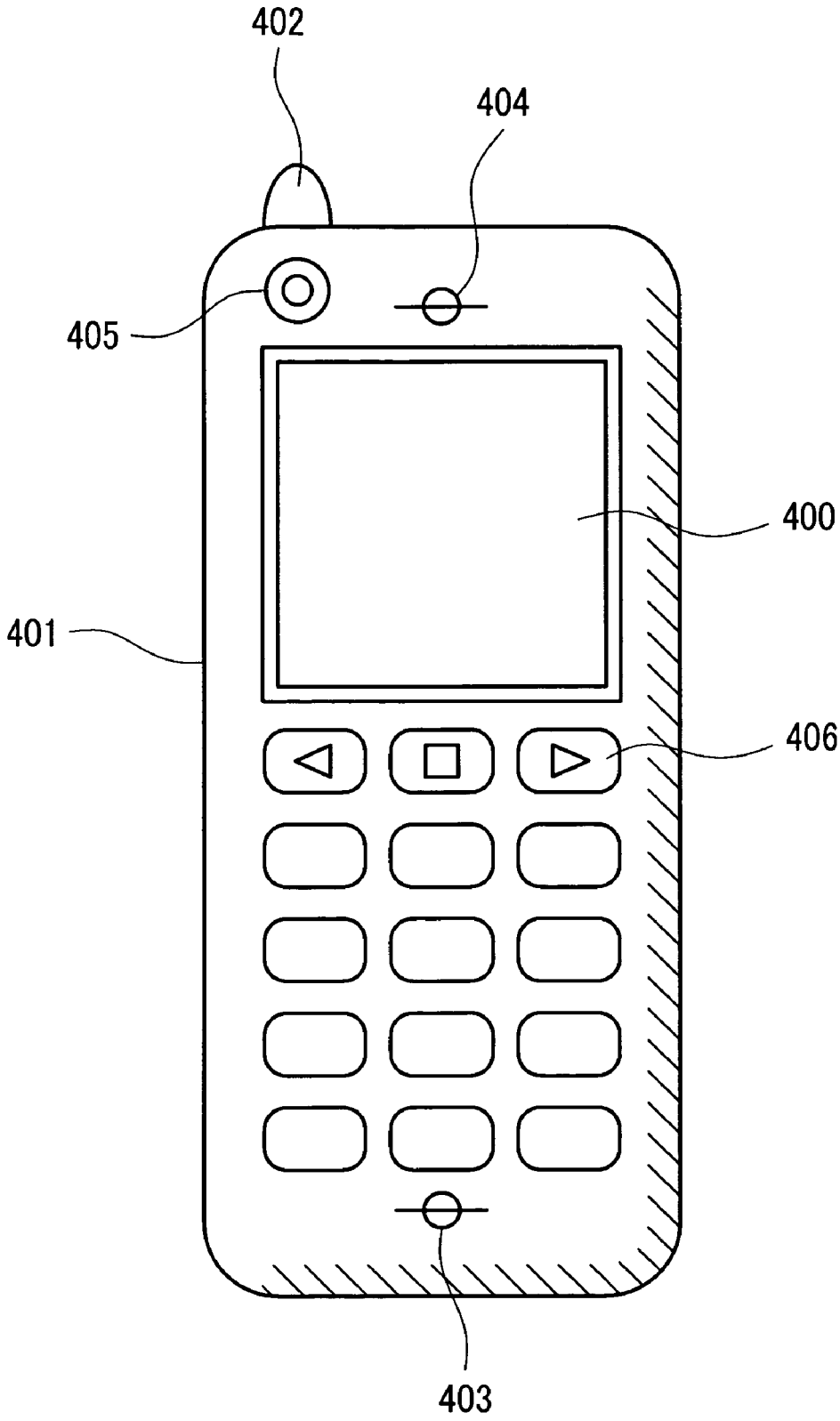
FIG. 15 is a view showing a mobile communications electronic device which applies the image display device according to the first or second embodiment of the present invention.

FIG. 15 shows an electronic device for mobile communications, based on the first embodiment or the second embodiment. In addition to an image display device 400 of the present invention, the electronic device 401 for mobile communications includes an antenna 402, a microphone 403, a loudspeaker 404, an image acquisition element 405, and audio playback buttons 406. Since the image display device according to the present invention has a small marginal region, it is possible to reserve a greater deal of spacer for arranging the members 401 to 406 or to dimensionally reduce the mobile communications electronic device 401 itself. Additionally, a manufacturing cost of the mobile communications electronic device 401 can be reduced since the image display device 400 is reduced in cost.

Figure 16:
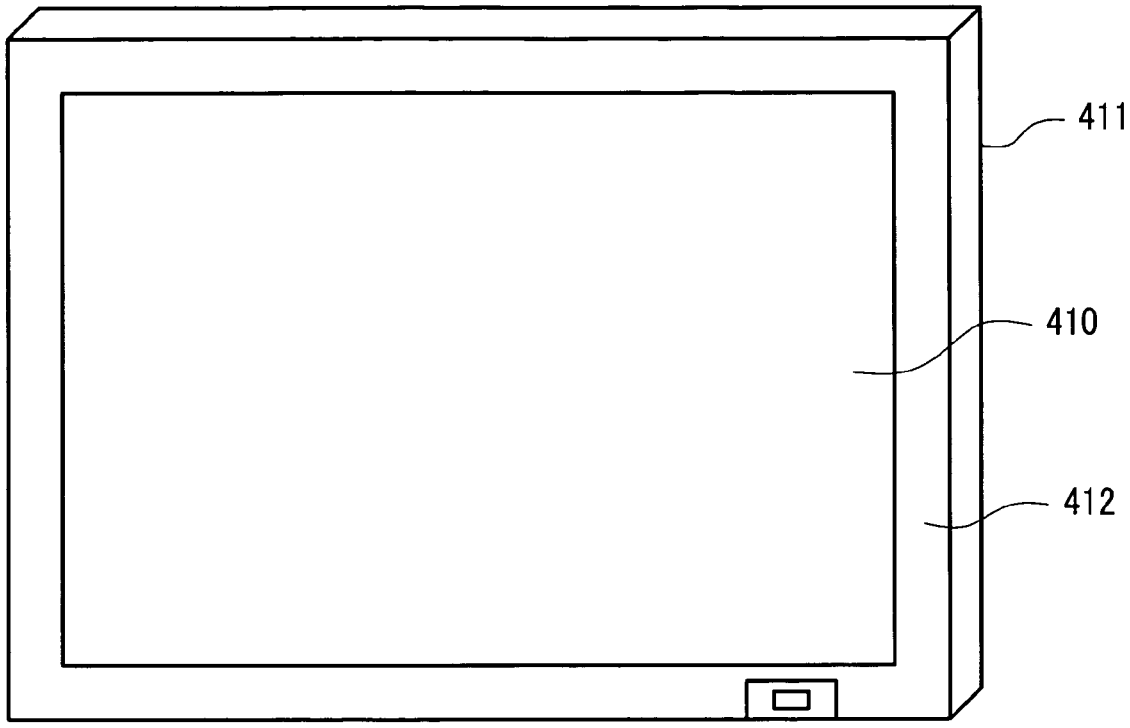
FIG. 16 shows a television that applies the image display device according to the first or second embodiment of the present invention.

FIG. 16 shows a television that applies the first embodiment or the second embodiment. Since the television 411 containing an image display device 410 of the present invention has a small marginal region, a marginal region 412 of the image display device can also be narrowed. Additionally, a manufacturing cost of the television 411 can be reduced since the image display device 410 is reduced in cost.

What is claimed is:

1. An image display device, comprising on a substrate:

a plurality of pixel circuits each including a light-emitting element and a circuit element which conducts quantitative control of an electric current supplied to the light-emitting element, wherein the pixel circuits are arrayed in a matrix form;

a data driver for supplying an image signal voltage to the plurality of pixel circuits;

a plurality of data lines, each of the data lines supplying the image signal voltage to the plurality of pixel circuits;

a scanning circuit that generates a pulse signal with each arrival of a vertical scanning period;

a plurality of gate lines intersecting with the data lines, each of the gate lines transmitting the pulse signal to the plurality of pixel circuits;

a waveform generator that generates a plurality of triangular-wave voltages each having different phases or a plurality of stair-step sweep voltages; and a plurality of triangular wave signal lines intersecting with the data lines, each of the triangular wave signal lines supplying one of the triangular wave voltages or one of the stair-step sweep voltages to the plurality of pixel circuits, wherein the circuit element controls the electric current supplied to the light-emitting element by comparing one of the triangular-wave voltages or one of the stair-step sweep voltages and the image signal voltage at the pulse signal input to the pixel circuit, wherein the waveform generator comprises:

a loop-form resistive wiring on the substrate, wherein the plurality of triangular wave signal lines are connected to the loop-form resistive wiring to have spatial phases;

a plurality of connection nodes provided on the loop-form resistive wiring;

a plurality of first voltage supply electrodes for supplying a maximum voltage of the triangular-wave voltage or the stair-step sweep voltage;

a plurality of second voltage supply electrodes for supplying a minimum voltage of the triangular-wave voltages or the stair-step sweep voltage;

a plurality of voltage switches, each said voltage switch associated with a connection node, comprising of two active elements for connecting one of the plurality of first and one of the plurality of second voltage supply electrodes with the associated connection node; and at least one shift register which control the voltage switches;

wherein connection positions of the plurality of first and plurality of second voltage supply electrodes with the plurality of connection nodes via the plurality of voltage switches are sequentially shifted by the at least one shift register at a same rate, such that the plurality of triangular-wave voltages each having different phase or the plurality of stair-step sweep voltages are generated at the plurality of connection nodes of the triangular wave signal lines on the loop-form resistive wiring.

2. The image display device, according to claim 1, wherein the at least one shift register comprises of two shift register circuits, the waveform generator being adapted such that, in accordance with a shifting operation of the two shift register circuits, the generator outputs to the pixels circuits the plurality of triangular-wave voltages or the plurality of stair-step sweep voltages occurring in the loop-form resistive wiring.

3. The image display device according to claim 1, wherein:

the scanning circuit generates scanning pulses of different timing;

the scanning pulses and one of the plurality of triangular-wave voltages or one of the plurality of stair-step sweep voltages are supplied to all of the pixel circuits such that the scanning pulses synchronize with the triangular-wave voltages or the stair-step sweep voltages.

4. The image display device according to claim 1, wherein:

the waveform generator uses thin-film transistors as active elements, and the waveform generator being disposed in a peripheral section of the device.

5. The image display device according to claim 1, wherein:

the loop-form resistive wiring is formed such that two linear wiring sections having different sheet resistance values are each interconnected at both ends for the loop-form resistive wiring to form a loop.

6. The image display device according to claim 5, wherein:

of the two linear wiring sections, the linear wiring section having a greater sheet resistance value is formed using the same wiring layer as that of wiring which forms a gate electrode of a thin-film transistor, and the linear wiring section having a smaller sheet resistance value is formed using the same wiring layer as that of wiring which connects to a drain electrode and source electrode of the thin-film transistor.

7. The image display device according to claim 1, wherein:

the loop-form resistive wiring includes a plurality of resistive elements and a plurality of wiring sections, the plurality of resistive elements and the plurality of wiring sections being interconnected in an alternate fashion to form a loop.

8. The image display device according to claim 7, wherein:

the plurality of resistive elements are each formed using the same wiring layer as that of a polycrystalline silicon film of a thin-film transistor; and the plurality of wiring sections are each formed using the same wiring layer as that of wiring which connects to a drain electrode and source electrode of the thin-film transistor.

* * * * *

UNITED STATES PATENT AND TRADEMARK OFFICE

CERTIFICATE OF CORRECTION

PATENT NO. : 7,932,881 B2
APPLICATION NO. : 11/544735
DATED : April 26, 2011
INVENTOR(S) : Hiroshi Kageyama and Hajime Akimoto It is certified that error appears in the above-identified patent and that said Letters Patent is hereby corrected as shown below:

On the title page, item (73) should read as follows:

(73) Assignee: Hitachi Displays, Ltd., Chiba (JP)

Signed and Sealed this
Eleventh Day of September, 2012

David J. Kappos

David J. Kappos
*Director of the United States Patent and Trademark Office*